US009857813B2

(12) United States Patent
Shrivastava

(10) Patent No.: US 9,857,813 B2
(45) Date of Patent: Jan. 2, 2018

(54) METHODS AND APPARATUS FOR LOW INPUT VOLTAGE BANDGAP REFERENCE ARCHITECTURE AND CIRCUITS

(71) Applicant: PsiKick, Inc., Charlottesville, VA (US)

(72) Inventor: Aatmesh Shrivastava, Charlottesville, VA (US)

(73) Assignee: PSIKICK, INC., Charlottesville, VA (US)

( * ) Notice: Subject to any disclaimer, the term of this patent is extended or adjusted under 35 U.S.C. 154(b) by 0 days.

(21) Appl. No.: 14/880,817

(22) Filed: Oct. 12, 2015

(65) Prior Publication Data

US 2016/0041570 A1 Feb. 11, 2016

Related U.S. Application Data

(63) Continuation of application No. 14/454,342, filed on Aug. 7, 2014, now Pat. No. 9,158,320, and a continuation of application No. PCT/US2015/043986, filed on Aug. 6, 2015.

(51) Int. Cl.

| | |
|---|---|
| ***G05F 1/46*** | (2006.01) |
| ***G05F 3/30*** | (2006.01) |
| ***G05F 3/18*** | (2006.01) |

(52) U.S. Cl.

CPC ..... *G05F 1/468* (2013.01); *G05F 3/18* (2013.01); *G05F 3/30* (2013.01)

(58) Field of Classification Search

CPC ... G05F 3/18; G05F 3/13; G05F 3/262; G05F 3/247; G05F 1/468; G05F 1/46; G05F 3/30

See application file for complete search history.

(56) References Cited

U.S. PATENT DOCUMENTS

| | | | | |
|---|---|---|---|---|
| 5,059,820 | A | 10/1991 | Westwick | |
| 6,060,874 | A * | 5/2000 | Doorenbos | G05F 3/30 323/316 |
| 6,819,163 | B1 * | 11/2004 | Gregoire, Jr. | G05F 3/262 327/536 |
| 7,122,998 | B2 | 10/2006 | Chen | |
| 7,129,774 | B1 | 10/2006 | Bosnyak | |

(Continued)

OTHER PUBLICATIONS

International Search Report and Written Opinion, dated Dec. 15, 2015 for PCT/US2015/043986, filed Aug. 6, 2015.

(Continued)

*Primary Examiner* — Gustavo Rosario Benitez
(74) *Attorney, Agent, or Firm* — Cooley LLP

(57) ABSTRACT

In some embodiments, an apparatus includes a bandgap reference circuit having a first bipolar junction transistor (BJT) that can receive a current from a node having a terminal voltage and can output a base emitter voltage. The apparatus also includes a second bipolar junction transistor (BJT) having a device width greater than a device width of the first BJT. The second BJT can receive a current from a node having a terminal voltage and output a base emitter voltage. In such embodiments, the apparatus also includes a reference generation circuit operatively coupled to the first BJT and the second BJT, where the reference generation circuit can generate a bandgap reference voltage based on the base emitter voltage of the first BJT and the base emitter voltage of the second BJT.

20 Claims, 19 Drawing Sheets

(56) References Cited

U.S. PATENT DOCUMENTS

| | | | | |
|---|---|---|---|---|
| 7,786,792 | B1 | 8/2010 | Gay | |
| 8,461,912 | B1 * | 6/2013 | Kumar | G05F 3/30 327/539 |
| 2002/0041531 | A1 | 4/2002 | Tanaka et al. | |
| 2004/0245977 | A1 | 12/2004 | Tran | |
| 2006/0268629 | A1 | 11/2006 | Senouci et al. | |
| 2007/0001746 | A1 | 1/2007 | Wei | |
| 2008/0129271 | A1 | 6/2008 | Fifield | |
| 2012/0326695 | A1 | 12/2012 | Chen | |
| 2013/0169259 | A1 * | 7/2013 | Saxena | G05F 3/30 323/313 |
| 2013/0293289 | A1 * | 11/2013 | Ivanov | G05F 3/20 327/539 |
| 2016/0054747 | A1 * | 2/2016 | Cohen | G05F 1/567 713/300 |

OTHER PUBLICATIONS

F. Zhang, et. al. "A Batteryless 19μW MICS/ISM-Band Energy Harvesting Body Area Sensor Node SoC," IEEE International Solid State Circuits Conference, Feb. 21, 2012, 3 pages.

Yu-Shiang Lin, et al. "A Sub-pW Timer Using Gate Leakage for Ultra Low-Power Sub-Hz Monitoring Systems," IEEE Custom Integrated Circuits Conference, SSEL Annual Report 2007, 1 page.

P. E. Allen, et al. "CMOS Analog Circuit Design," Second Edition, Oxford University Press, 2002, 797 pages.

R. J. Wildar "New developments in IC voltage regulators," IEEE Journal of Solid State Circuits, vol. SC-6, No. 1, Feb. 1971, pp. 2-7.

K. E. Kujik "A Precision Reference Voltage Source," IEEE Journal of Solid State Circuits, vol. SC-8, No. 3, Jun. 1973, pp. 222-226.

A. P. Brokaw, "A Simple Three-Terminal IC Bandgap Reference," IEEE Journal of Solid State Circuits, vol. SC-9, No. 6, Dec. 1974, pp. 388-393.

P. Kinget, et al. "Voltage References for Ultra-Low Supply Voltages," IEEE Custom Integrated Circuits Conference (CICC), 2008, pp. 715-720.

M. Seok, et al. "A 0.5V 2.2pW 2-Transistor Voltage Reference," IEEE Custom Integrated Circuits Conference (CICC), 2009, pp. 577-580.

K. N. Leung, et al. "A CMOS Voltage Reference Based on Weighted $\Delta V_{GS}$ for CMOS Low-Dropout Linear Regulators," IEEE Journal of Solid State Circuits, vol. 38, No. 1, Jan. 2003, pp. 146-150.

H. Banba, et al. "A CMOS Bandgap Reference Circuit with Sub-1-V Operation," IEEE Journal of Solid State Circuits, vol. 34, No. 5, May 1999, pp. 670-674.

K, Sanborn, et al. "A Sub-1-V Low-Noise Bandgap Voltage Reference," IEEE Journal of Solid State Circuits, vol. 42, No. 11, Nov. 2007, pp. 2466-2481.

V. Ivanov, et al. "An Ultra Low Power Bandgap Operational at Supply From 0.75V," IEEE Journal of Solid-State Circuits, vol. 47, No. 7, Jul. 2012, pp. 1515-1523.

K. Ueono, et al. "A 300 nW 15 ppm/° C., 20 ppm/V CMOS Voltage Reference Circuit Consisting of Subthreshold MOSFETs," IEEE Journal of Solid-State Circuits, vol. 44, No. 7, Jul. 2009, pp. 2047-2054.

P. Favrat, et al. "A High-Efficiency CMOS Voltage Doubler," IEEE Journal of Solid-State Circuits, vol. 33, No. 3, Mar. 1998, pp. 410-416.

A. Richelli, et al. "A 1.2-to-8V Charge-Pump with Improved Power Efficiency for Non-Volatile Memories," IEEE Solid-State Circuits Conference, Feb. 14, 2007, pp. 522-523 and 619.

* cited by examiner

METHODS AND APPARATUS FOR LOW INPUT VOLTAGE BANDGAP REFERENCE ARCHITECTURE AND CIRCUITS

CROSS REFERENCE TO RELATED APPLICATION

This application is a continuation of U.S. patent application Ser. No. 14/454,342, entitled "Methods and Apparatus for Low Input Voltage Bandgap Reference Architecture and Circuits," filed Aug. 7, 2014 (now U.S. Pat. No. 9,158,320), which is incorporated herein by reference in its entirety.

This application is also continuation of International Patent Application No. PCT/US15/43986, entitled "Methods and Apparatus for Low Input Voltage Bandgap Reference Architecture and Circuits," filed Aug. 6, 2015, which is incorporated herein by reference in its entirety.

BACKGROUND

Some embodiments described herein relate generally to methods and apparatus for generating a temperature insensitive bandgap voltage reference using an input (supply) voltage that is lower than the base-emitter voltage ($V_{BE}$) of a bipolar junction transistor (BJT).

Portable electronic/electrical systems that operate from a battery and/or from power harvested from the internal local environment typically consume small amounts of energy to prolong the system lifetime for a given amount of available energy. The energy budget for a portable system affects a widening set of applications due to a combination of requirements for smaller size (less battery volume, and hence less energy available), longer lifetimes (energy has to last longer), and/or more functionality (increased number of applications to implement with the same amount of energy). Many sensing applications use integrated circuits (ICs) or systems on chip (SoCs) to perform the sensing, computation, and communication functions that are used by a variety of applications.

In many cases, the time between sensor measurements can be relatively long such that the IC or SoC spends a substantial fraction of its lifetime in a standby mode. Known techniques reduce power consumed by the IC or SoC during standby mode, for example, by power gating unused circuit blocks. A subset of circuit blocks remains powered up during all times of device operation including, for example, a DC-DC regulator remains powered up to supply a stable operating voltage, $V_{DD}$, which in turn involves a voltage reference to set the correct value for $V_{DD}$. Typically, the most commonly used voltage reference is a bandgap reference that uses the silicon bandgap voltage to generate a temperature independent voltage reference.

An ideal voltage reference is independent of variation of power supply or temperature. A voltage reference is often included in many circuits, such as analog-to-digital converters, DC-DC converters, energy harvesting circuits, timing generation circuits, or other voltage regulators. Known implementations of bandgap reference typically involve the use of bipolar junction transistors (BJT) and large resistors to provide generate the bandgap voltage reference. Known conventional bandgap reference circuits, however, are limited to using input voltages higher than the base-emitter voltage ($V_{BE}$) of a BJT because they inject a current into the BJT using a current source, current mirror, resistor, or switched capacitor network at a voltage higher than $V_{BE}$.

Accordingly, for severely energy constrained electronic/electrical systems, a need exists for bandgap reference circuits with a low input voltage to allow for compatibility with energy harvesting and sub-threshold digital logic voltage levels. Additionally, a need exists to minimize power consumption for the bandgap reference circuit.

SUMMARY

In some embodiments, an apparatus includes a bandgap reference circuit having a first bipolar junction transistor (BJT) that can receive a current from a node having a terminal voltage and can output a base emitter voltage. The terminal voltage of the first BJT substantially corresponds to or is lower than the base emitter voltage of the first BJT for at least a time period. In such embodiments, the apparatus also includes a second bipolar junction transistor (BJT) having a device width greater than a device width of the first BJT. The second BJT can receive a current from a node having a terminal voltage and output a base emitter voltage, where the terminal voltage of the second BJT substantially corresponds to or is lower than the base emitter voltage of the second BJT for at least a time period. In such embodiments, the apparatus also includes a reference generation circuit operatively coupled to the first BJT and the second BJT, where the reference generation circuit can generate a bandgap reference voltage based on the base emitter voltage of the first BJT and the base emitter voltage of the second BJT.

DETAILED DESCRIPTION

Figure 1:
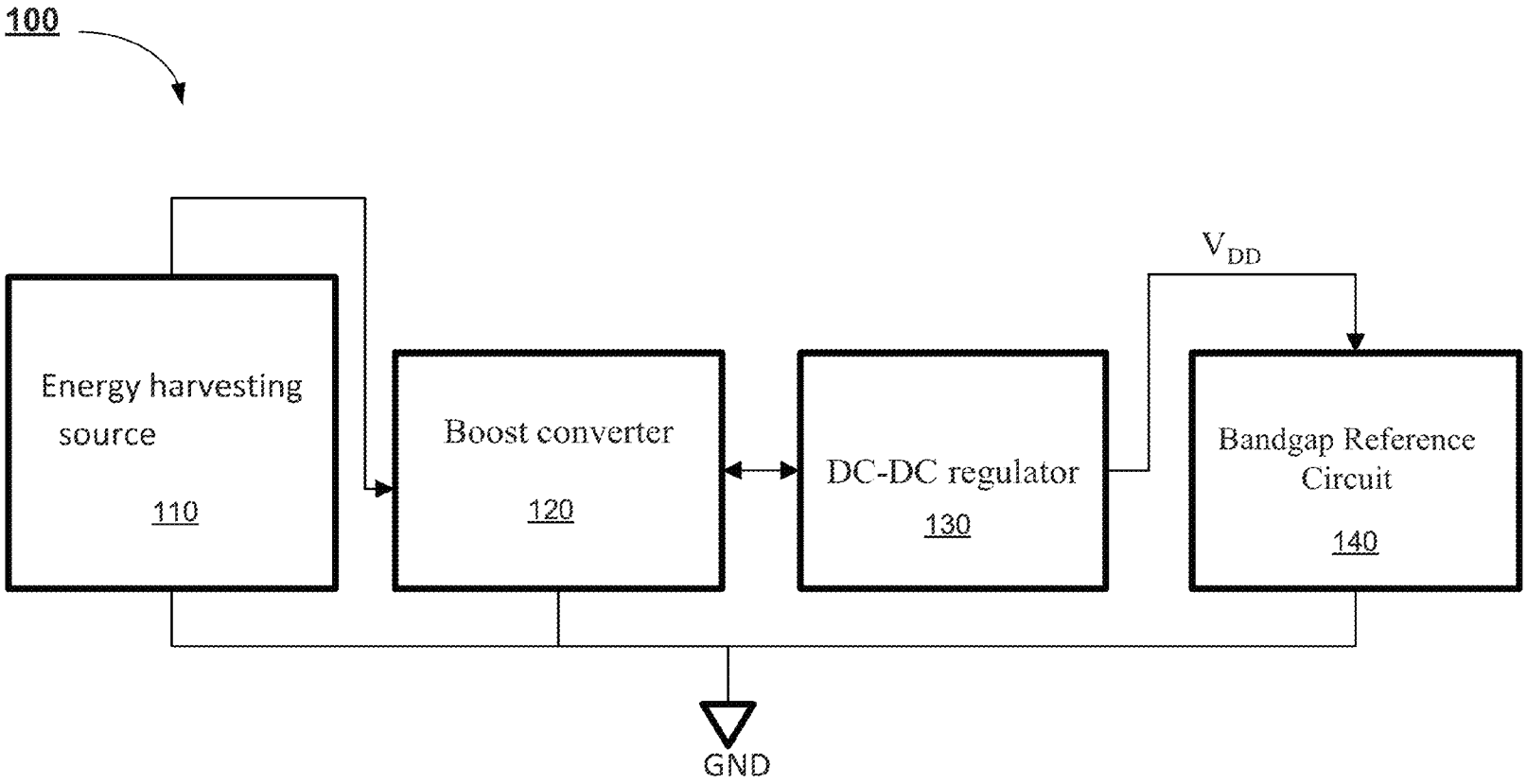
FIG. 1 is a block diagram of an integrated system used for feeding an input voltage to a bandgap reference circuit used in known portable electrical systems.

In some embodiments, an apparatus includes a bandgap reference circuit having a first bipolar junction transistor (BJT) that can receive a current from a node having a terminal voltage and can output a base emitter voltage. The terminal voltage of the first BJT substantially corresponds to or is lower than the base emitter voltage of the first BJT for at least a time period. In such embodiments, the apparatus also includes a second bipolar junction transistor (BJT) having a device width greater than a device width of the first BJT. The second BJT can receive a current from a node having a terminal voltage and output a base emitter voltage, where the terminal voltage of the second BJT substantially corresponds to or is lower than the base emitter voltage of the second BJT for at least a time period. In such embodiments, the apparatus also includes a reference generation circuit operatively coupled to the first BJT and the second BJT, where the reference generation circuit can generate a bandgap reference voltage based on the base emitter voltage of the first BJT and the base emitter voltage of the second BJT.

In some embodiments, an apparatus includes a base emitter voltage generation circuit having a bipolar junction transistor (BJT) configured to receive, in a voltage clamp configuration, a current from charge pump circuit and at a node having an input voltage and to output a base emitter voltage, where the input voltage substantially corresponds to or is lower than the base emitter voltage.

In some embodiments, an apparatus includes a clock circuit that is operatively coupled to a bandgap reference circuit, where the clock circuit has a first circuit portion that can receive from an on-chip clock a clock signal having an input voltage. The first circuit portion can produce (1) a first clock phase signal having a minimal voltage and a maximum voltage, and (2) a second clock phase signal non-overlapping with the first clock phase signal and having a minimal voltage and a maximum voltage. In such embodiments, the clock circuit also has a second circuit portion that is operatively coupled to the first circuit portion, where the second circuit portion includes a set of capacitors and a set of invertors that can collectively output a third clock phase signal and a fourth clock phase signal, the third clock phase signal and the fourth clock phase signal each having a minimal voltage greater than the minimum voltage of the first clock phase signal and the minimal voltage of the second clock phase signal. The third clock phase signal and the fourth clock phase signal each also has a maximum voltage greater than the maximum voltage of the first clock phase signal and the maximum voltage of the second clock phase signal. In such embodiments, the clock circuit also has a third circuit portion operatively coupled to the second circuit portion, where the third circuit portion includes a set of transistors that can output a fifth clock phase signal and a sixth clock phase signal. The fifth clock phase signal and the sixth clock phase signal each has a minimal voltage substantially equal to the minimum voltage of the first clock phase signal and the minimal voltage of the second clock phase signal. The fifth clock phase signal and the sixth clock phase signal each also has a maximum voltage substantially equal to the maximum voltage of the fourth clock phase signal and the maximum voltage of the fifth clock phase signal.

As used in this specification, the singular forms "a," "an" and "the" include plural referents unless the context clearly dictates otherwise. Thus, for example, the term "a transistor" is intended to mean a single transistor or a combination of transistors.

FIG. 1 is a block diagram of an integrated system used for feeding an input voltage to a bandgap reference circuit used in known portable electrical systems. The integrated system 100 is typically associated with larger electrical systems and, for example, can obtain energy from an external energy source 110 (e.g., a battery) using any number of energy harvesting mechanisms and in some instances, a boost converter 120. The boost converter 120 typically enhances or boosts the voltage obtained from the energy harvesting source 110 to a value above $V_{BE}$. This can further be stabilized by the DC-DC regulator 130 before being sent to the bandgap reference circuit 140. Typical known bandgap reference circuits such as the bandgap reference circuit 140 are limited to using input voltages higher than $V_{BE}$ of a BJT because such known bandgap reference circuits inject a current into the BJT using a current source, current mirror, resistor, or switched capacitor network at a voltage higher than $V_{BE}$. Achieving a lower operational output voltage from the bandgap reference circuit 140, however, is desirable for ultra-low-power (ULP) devices that include complex ICs, SoCs, body sensor nodes (BSNs) and wireless sensors for the internet of things. The output voltage from the bandgap reference circuit 140 determines the voltage at which the ULP device can turn on and operate because the reference voltage is used to turn on the power supplies of the ULP device. A lower bandgap reference voltage will reduce the turn-on voltage for the ULP device, reduce power loss, and increase the operational lifetime of the ULP device. Additionally, a lower bandgap reference voltage can also assist in the miniaturization of ULP devices.

Figure 2:
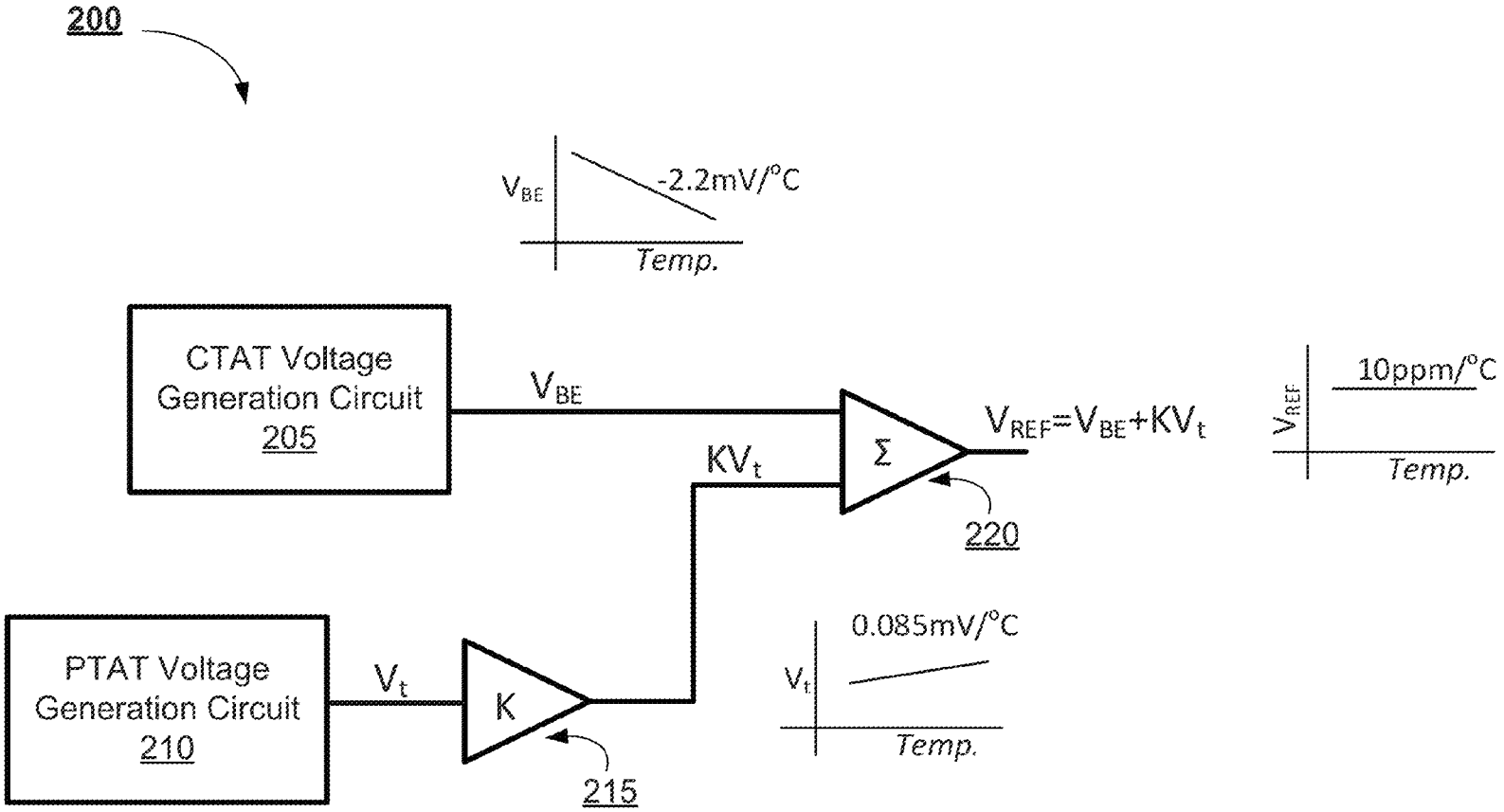
FIG. 2 is a schematic diagram representing a bandgap reference circuit generating a constant voltage reference across varying temperatures, according to an embodiment.

FIG. 2 is a schematic diagram representing a bandgap reference circuit generating a constant voltage reference across varying temperatures, according to an embodiment. The bandgap reference circuit 200 includes a BJT base emitter voltage ($V_{BE}$) generated by a complementary-to-absolute-temperature (CTAT) voltage generation circuit 205. The CTAT voltage generation circuit 205 includes a BJT (not shown in FIG. 2) connected to a power source (not shown in FIG. 2) in a diode configuration. The CTAT voltage corresponds to the $V_{BE}$ of the BJT transistor. The value of $V_{BE}$ decreases with increasing temperature because of the generation of increased number of carrier with increased temperature. Because the number of carriers increases with temperature, the conductivity of the transistor (i.e., BJT) increases, thus decreasing the value of $V_{BE}$. In the example of FIG. 2, the $V_{BE}$ decreases with increasing temperature with a slope given by −2.2 mV/° C. The voltage $V_t$ is the output of the proportional-to-absolute-temperature (PTAT) voltage generation circuit 210. Unlike the CTAT voltage generation circuit 205, here the output voltage increases in magnitude with increasing temperature. In the example of FIG. 2, the voltage $V_t$ increases with increasing temperature with a slope given by 0.085 mV/° C. The voltage $V_t$ is multiplied with a constant K at the multiplier 215 and added to the CTAT voltage ($V_{BE}$) at the adder 220 to generate the bandgap reference voltage $V_{REF}$ (where $V_{REF}=V_{BE}+KV_t$) that is temperature independent. The value of the constant K at the multiplier 215 is chosen such that the temperature dependence of the CTAT portion and PTAT portion of the bandgap reference circuit 200 cancel each other and $V_{REF}$ becomes a temperature independent voltage reference (typically in the range of less than 10 ppm/° C.).

Figure 3:
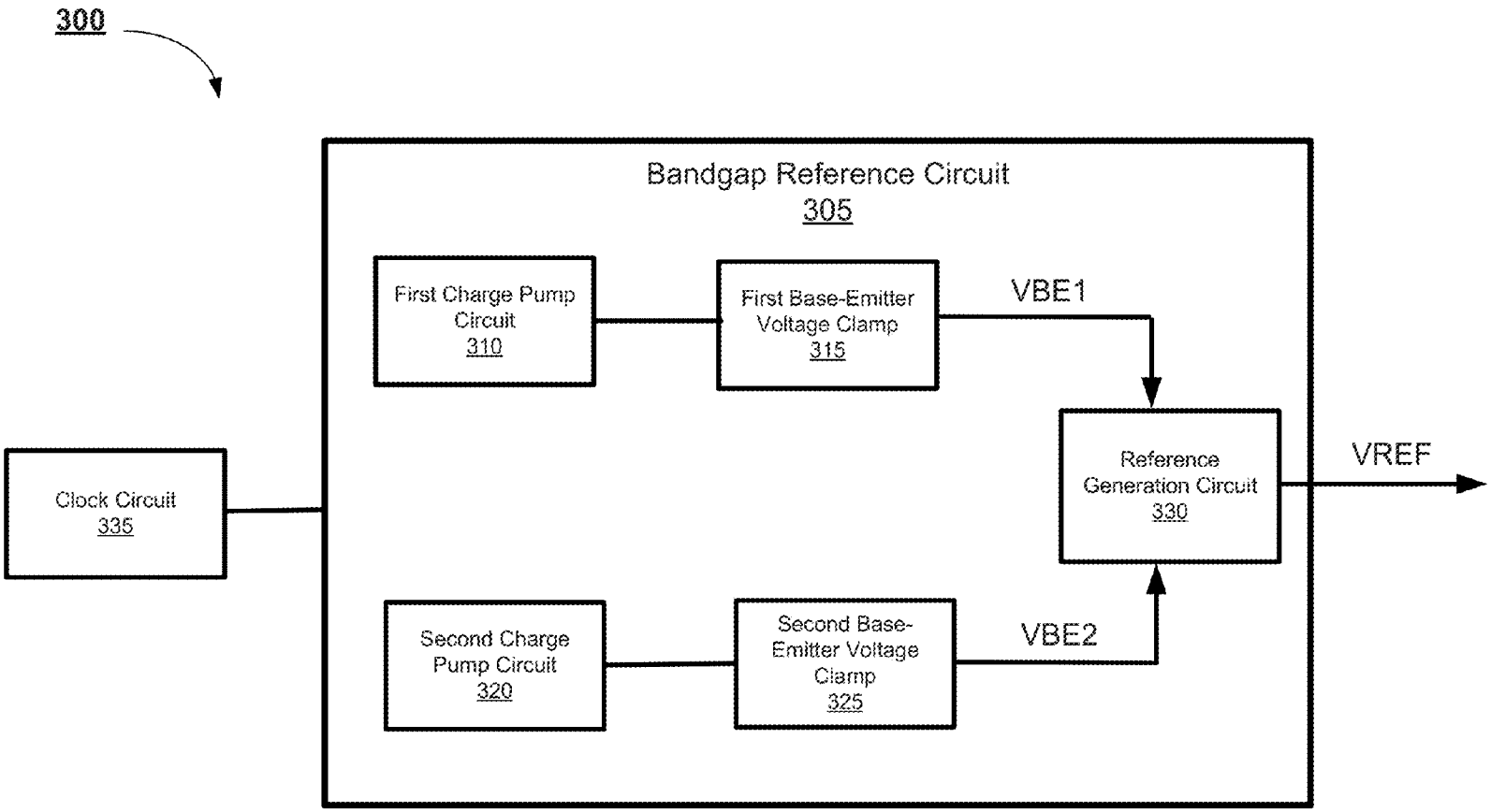
FIG. 3 is a schematic illustration of a bandgap reference circuit system that uses an input voltage less than the base-emitter voltage of a bipolar junction transistor, according to an embodiment.

FIG. 3 is a schematic illustration of a bandgap reference circuit system that uses an input voltage less than the base-emitter voltage of a bipolar junction transistor. The bandgap reference circuit system 300 includes a bandgap reference circuit 305 operably coupled to a clock circuit 335. The bandgap reference circuit 305 includes a first charge pump circuit 310, a second charge pump circuit 320, a first base-emitter voltage clamp 315, a second base-emitter voltage clamp 325, and a reference generation circuit 330. It is to be noted that the BJT in the second base-emitter voltage clamp 325 has a device width greater than the device width of the BJT in the first base-emitter voltage clamp 315. The bandgap reference circuit system 300 can generate a temperature insensitive bandgap reference voltage ($V_{REF}$) using an input (supply) voltage that is lower than the base-emitter voltage ($V_{BE}$) of a BJT. In such instances, the first charge pump circuit 310 (e.g., a boost circuit such as a switched capacitor circuit) drives a current into the first base-emitter voltage clamp 315 (e.g., including a first bipolar junction transistor (BJT) connected in parallel to a first load capacitor) from a voltage that is lower than the $V_{BE}$ of the BJT in the first base-emitter voltage clamp 315. This causes the first base-emitter voltage clamp 315 to clamp its base-emitter voltage at $V_{BE1}$. Similarly, the second charge pump circuit 320 drives a current into the second base-emitter voltage clamp 325 (e.g., also including a second BJT connected in parallel to a second load capacitor) from a voltage that is lower than the $V_{BE}$ of the BJT in the second base-emitter voltage clamp 325. This causes the second base-emitter voltage clamp 325 to clamp its base-emitter voltage at a different voltage $V_{BE2}$. The reference generation circuit 330 can include, for example, a programmable switched capacitor circuit can generate a temperature insensitive bandgap reference voltage ($V_{REF}$) from $V_{BE1}$ and $\Delta V_{BE}$ ($V_{BE1}-V_{BE2}$), which can be any fractional multiple of the silicon bandgap voltage. In some configurations, the reference generation circuit 330 can include a capacitor that can store the voltage $\Delta V_{BE}$. In such configurations, the reference generation circuit 330 can also include a summing circuit that can generate various constants for $V_{BE1}$ and $\Delta V_{BE}$, which are then added to generate the desired temperature insensitive bandgap reference voltage ($V_{REF}$).

It is to be noted that the process of generating constants for $V_{BE1}$ and $\Delta V_{BE}$ can be, for example, a time-gated process where clock phase signals with different time intervals (non-overlapping) are used to open and close various switches in charge pump circuits 310 and 320 and the reference generation circuit 330. Such clock phases are defined by discrete clock signals that are sent by the clock circuit 335 that is operably coupled to the bandgap reference circuit 305. The clock circuit 335 can provide clock signals of different frequencies from, for example, an on-chip oscillator, a crystal oscillator or any other clock source. Additionally, the clock circuit 335 also includes a clock doubler circuit that is used to double the swing of the output clock signal to enable switches that can pass at least a voltage level of $V_{BE}$. The clock circuit 335 will be discussed in greater detail below in relation to FIGS. 11-16.

Figure 4:
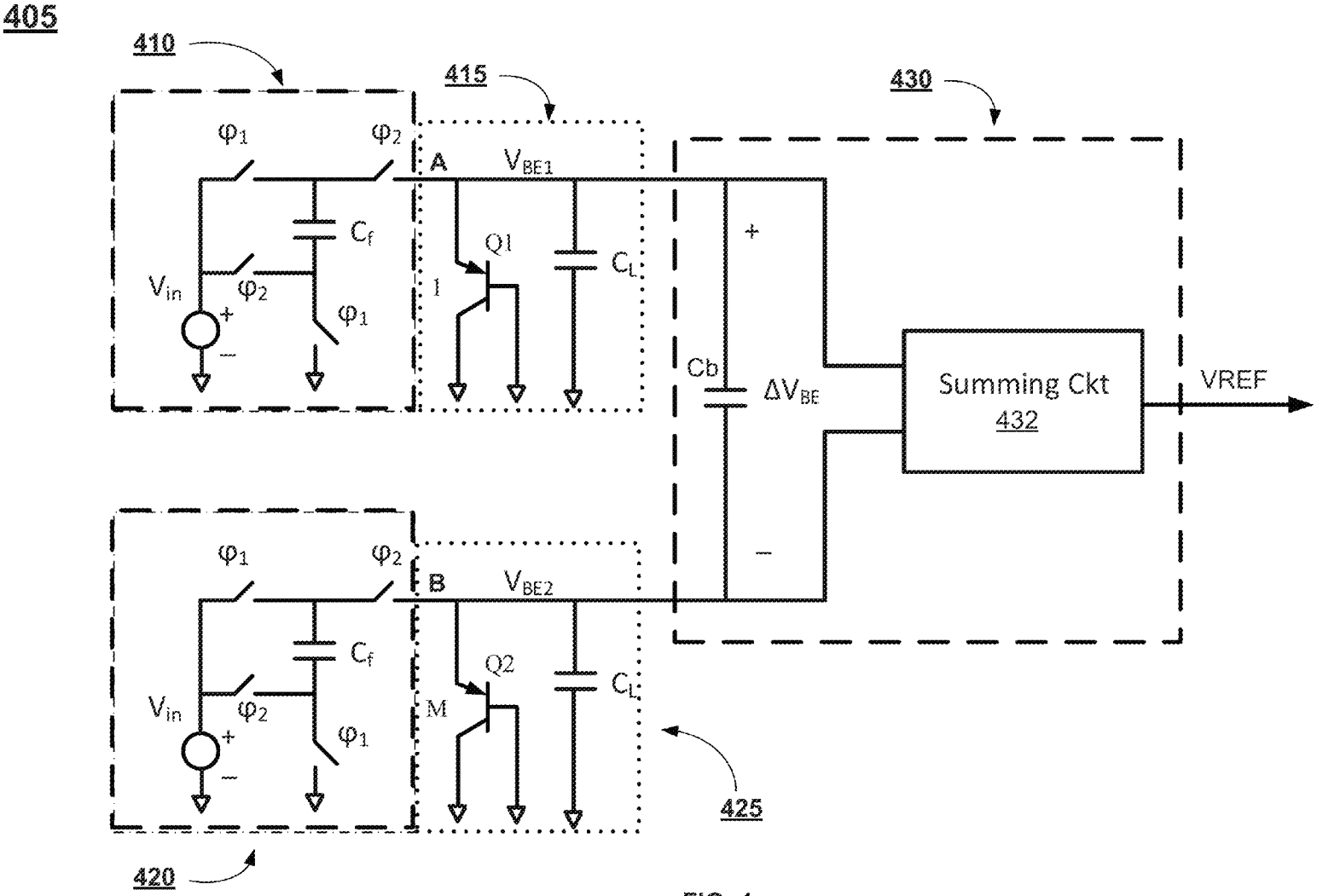
FIG. 4 is a schematic illustration of a bandgap reference circuit that uses switched capacitor charge pumps to drive an input voltage less than the base-emitter voltage of a bipolar junction transistor, according to an embodiment.

FIG. 4 is a schematic illustration of a bandgap reference circuit that uses switched capacitor charge pumps to drive an input voltage less than the base-emitter voltage of a bipolar junction transistor, according to an embodiment. The bandgap reference circuit 405 includes switched capacitor charge pumps 410 and 420 (that each include capacitors $C_f$), base-emitter voltage clamp 415 (that includes BJT transistor Q1 and capacitor $C_L$), base-emitter voltage clamp 425 (that includes BJT transistor Q2 and capacitor $C_L$), and the reference generation circuit 430 that includes the summing circuit 432 and the capacitor $C_b$ that stores the voltage $\Delta V_{BE}$. The switched capacitor charge pump 410 typically generates voltages from the source $V_{in}$. The output of the switched capacitor charge pump 410 is connected to the BJT Q1, which in turn clamps its output voltage to $V_{BE1}$. Similarly, the switched capacitor charge pump 420 also generates voltages from $V_{in}$. The output of the switched capacitor charge pump 420 is connected to the BJT Q2, which in turn clamps its output voltage to $V_{BE2}$. The use of the charge pumps 410 and 420 to drive current into the BJTs Q1 and Q2 enables low voltage operation of the bandgap reference circuit 405. Additionally, the clock circuit (e.g., clock circuit 335 shown in FIG. 3), which is used to supply the clock signals for the two clock phases $\phi_1$ and $\phi_2$ used in the operation of the switched capacitor charge pumps 410 and 420, can be made to operate at lower frequencies and input voltage ($V_{in}$) to reduce power consumption. The lower $V_{in}$ and the lower clock frequency for the switched capacitor charge pumps 410 and 420 enables lower power consumption when compared to known bandgap voltage reference generators. Each of the sub-components (e.g., the charge pumps 410 and 420 and the reference generator circuit 430) of the bandgap reference circuit 405 shown in FIG. 4 is described below.

For the bandgap reference circuit 405 shown in FIG. 4, in some instances, the first BJT Q1 can receive a current from a node (marked as A) having a first terminal voltage and can output a first base-emitter voltage ($V_{BE1}$), where the first terminal voltage (i.e., voltage at node A) substantially corresponds to or is lower than $V_{BE1}$. In such instances, the second BJT Q2 can receive a current from a node (marked as B) having a second terminal voltage and can output a second base-emitter voltage ($V_{BE2}$), where the second terminal voltage (i.e., voltage at node B) substantially corresponds to or is lower than $V_{BE2}$. Note that the second BJT Q2 has a device width greater than the first BJT Q1 (as seen by 1 representing Q1 and M representing Q2 in FIG. 4, where M>1). Additionally, in such instances, the bandgap reference circuit 405 also includes a reference generation circuit 430 that is operatively coupled to the first BJT Q1 and the second BJT Q2, where the reference generation circuit 430 can generate a bandgap reference voltage ($V_{REF}$) based on the base emitter voltage of the first BJT Q1 ($V_{BE1}$) and the base emitter voltage of the second BJT Q2 ($V_{BE2}$).

In the configuration of the bandgap reference circuit 405 shown in FIG. 4, the first BJT Q1 can receive the terminal voltage for the first BJT Q1 (at node A) from a supply (e.g., $V_{in}$) without generation of an intermediate voltage that is higher than the base emitter voltage of the first BJT Q1 ($V_{BE1}$). Similarly, the second BJT Q2 can receive the terminal voltage for the second BJT Q2 (at node B) from a supply (e.g., $V_{in}$) without generation of an intermediate voltage that is higher than the base emitter voltage of the second BJT Q2 ($V_{BE2}$). Note that the first BJT Q1 receives the current for the first BJT Q1 from the first charge pump circuit 410 via at least one capacitor $C_f$. Similarly, the second BJT Q2 receives the current for the second BJT Q2 from the second charge pump circuit 420 via at least one capacitor $C_f$.

Referring to FIGS. 3 and 4, the first charge pump circuit 410 is operatively coupled to the first BJT Q1 and a clock circuit (e.g., clock circuit 335 in FIG. 3). The first charge pump circuit 410 can receive an input voltage ($V_{in}$) and can output the terminal voltage of the first BJT Q1 at node A, where $V_{in}$ is less than the terminal voltage at node A. Similarly, the second charge pump circuit 420 is operatively coupled to the second BJT Q2 and a clock circuit (e.g., clock circuit 335 in FIG. 3). The second charge pump circuit 420 can receive an input voltage ($V_{in}$) and can output the terminal voltage of the second BJT Q2 at node B, where $V_{in}$ is less than the terminal voltage at node B. Note that the frequency of the clock signal send by the clock circuit 335 varies inversely with the terminal voltage for the first BJT Q1 (i.e., voltage at node A).

The clock circuit 335 sends a clock signal having a first clock phase $\phi_1$ and a second clock phase $\phi_2$. The first charge pump circuit 410 has a first configuration when receiving the first clock phase $\phi_1$ signal and a second configuration when receiving the second clock phase $\phi_2$ signal (as discussed in greater detail in relation to FIGS. 5-6 below). The first charge pump circuit 410 can output the terminal voltage of the first BJT Q1 (i.e., voltage at node A) based on a charge stored at a first capacitor ($C_f$) during the first configuration and the second configuration of the first charge pump 410 (as discussed in greater detail in relation to FIGS. 5-6 below). Similarly, the first charge pump circuit 420 has a first configuration when receiving the first clock phase $\phi_1$ signal and a second configuration when receiving the second clock phase $\phi_2$ signal. The second charge pump circuit 420 can output the terminal voltage of the second BJT Q2 (i.e., voltage at node B) based on a charge stored at a first capacitor ($C_f$) during the first configuration and the second configuration of the first charge pump 420.

Figure 5A:
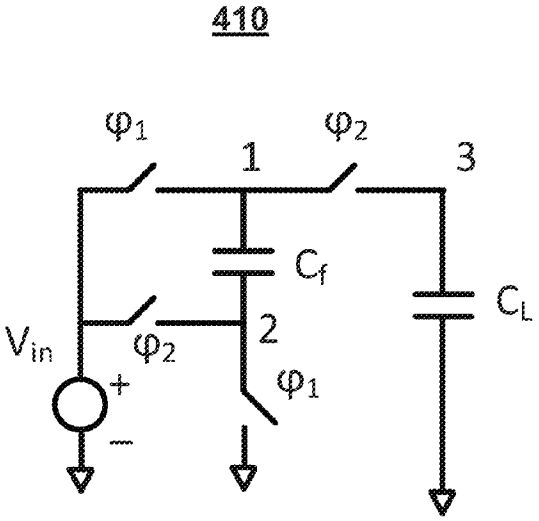
FIGS. 5A-C are schematic illustrations showing the charging of a switched capacitor charge pump circuit associated with the bandgap reference circuit shown in FIG. 4.
Figure 5B:
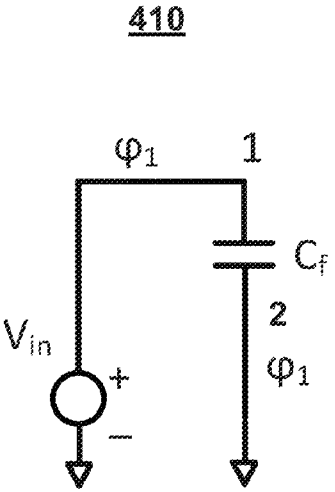
Figure 5C:
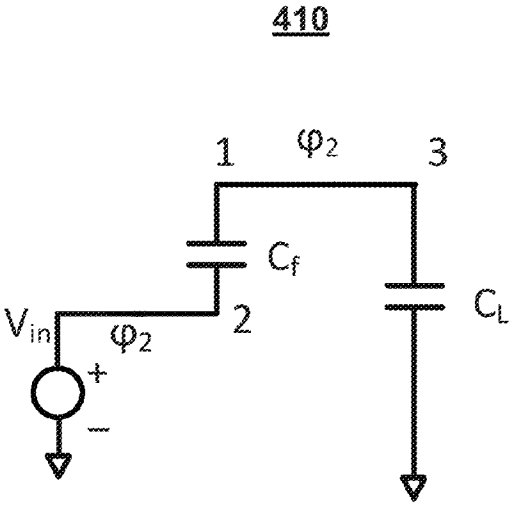

FIGS. 5A-C are schematic illustrations showing the charging of a switched capacitor charge pump circuit associated with the bandgap reference circuit shown in FIG. 4. The switched capacitor charge pump 410 (also known as charge pump circuit) shown in FIGS. 4 and 5A-C can boost the input voltage $V_{in}$ by a factor of two (i.e., $2*V_{in}$) and can also be used to output a voltage value of lower than $V_{in}$. The unloaded charge pump circuit 410 shown in FIG. 5A uses non-overlapping clock phases $\phi_1$ and $\phi_2$, respectively. During operation in clock phase $\phi_1$ as shown in FIG. 5B, node 1 is connected to $V_{in}$, and node 2 (shown in FIG. 5B) is connected to ground, charging the top plate of the capacitor $C_f$ to $V_{in}$ and the bottom plate of the capacitor $C_f$ to ground. During operation in clock phase $\phi_2$ as shown in FIG. 5C, node 2 is connected to $V_{in}$ and node 1 to the output capacitor $C_L$. Because the top plate of the capacitor $C_f$ was charged to $V_{in}$ during clock phase $\phi_1$, charging the bottom plate of capacitor $C_f$ to $V_{in}$ in clock phase $\phi_2$ allows the voltage at node 1 to go to $2*V_{in}$ because the voltage across the capacitor $C_f$ is $V_{in}$. The capacitor $C_L$ eventually charges to a voltage of $2*V_{in}$ after a given number of switching cycles at startup. Hence, the unloaded charge pump circuit 410 shown in FIG. 5A can generate a voltage that is twice the input voltage $V_{in}$.

Figure 6:
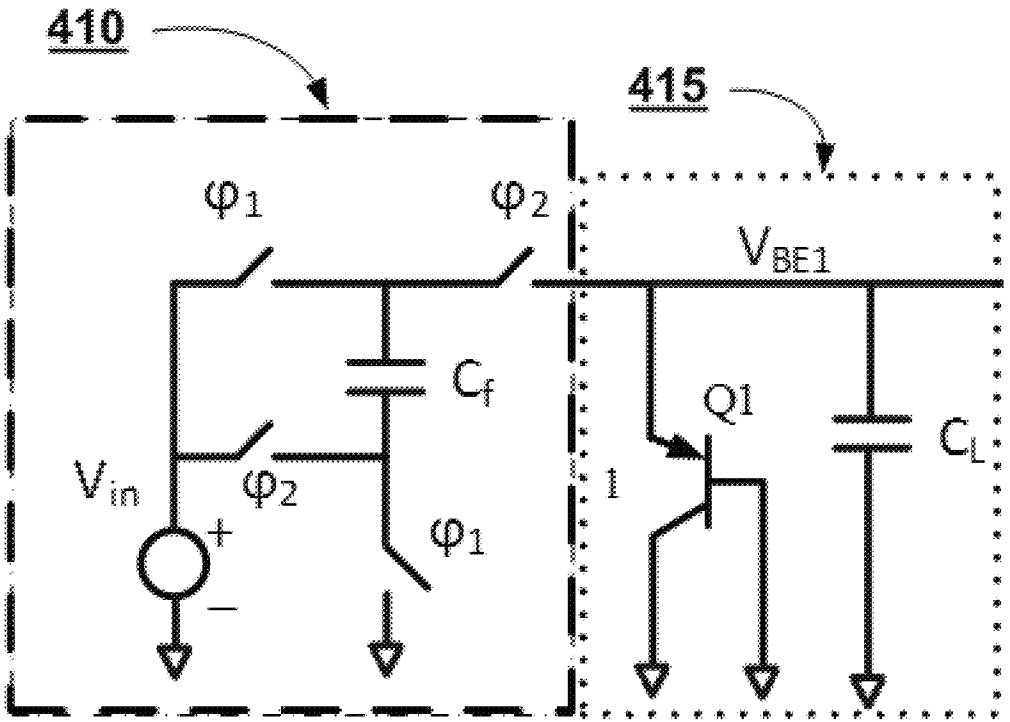
FIG. 6 is a schematic illustration of the charged switched capacitor charge pump circuit shown in FIG. 5A driving an input current into a base emitter voltage clamp.

FIG. 6 is a schematic illustration of the charged switched capacitor charge pump circuit shown in FIG. 5A driving an input current into a base emitter voltage clamp. The output of the charged switched capacitor charge pump circuit 410 is connected to the BJT Q1 of the base emitter voltage clamp 415. Note the similar charged switched capacitor charge pump circuit 420 can be used to drive the base emitter voltage clamp 425 that includes the BJT Q2 (that in the example of FIG. 4 is M times bigger than Q1). In the absence of the BJT transistor Q1, the output of the base emitter voltage clamp 415 would go to $2*V_{in}$. The presence of the BJT transistor Q1, however, restricts the output voltage of the base emitter voltage clamp 415 to $V_{BE1}$. A significant advantage of the circuit shown in FIG. 6 is that the voltage $V_{in}$ involved in generating $V_{BE1}$ is smaller than $V_{BE}$ (where $V_{BE}=V_{BE1}$ for the case of transistor Q1 and $V_{BE}=V_{BE2}$ for the case of transistor Q2). The minimum voltage for the bandgap to be operational $V_{min}$ is given by the following equation:

$$V_{min} > \frac{V_{BE}}{N} \tag{1}$$

Where N=2 is applicable for a voltage doubling switched capacitor charge pump as described in FIGS. 4-6. Eq. 1 shows that in some other configurations, if a voltage tripler or a higher order (i.e., N) switched capacitor charge pump is used, even lower values of $V_{in}$ can be obtained.

Figure 7A:
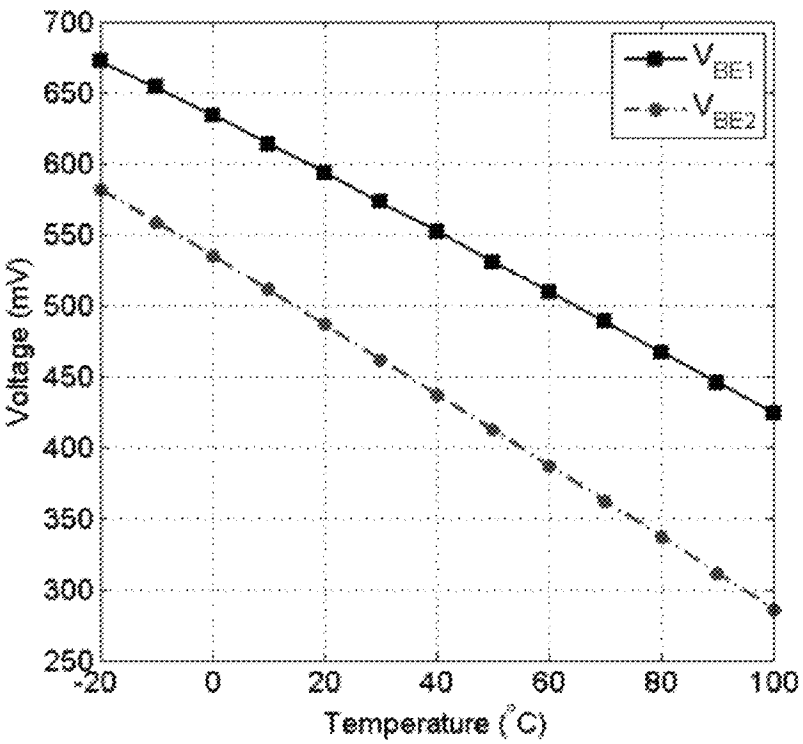
FIGS. 7A-7B present simulation results of the variation of $V_{BE}$ and $\Delta V_{BE}$ as a function of temperature that is generated from the bandgap voltage reference circuit of FIG. 4.
Figure 7B:
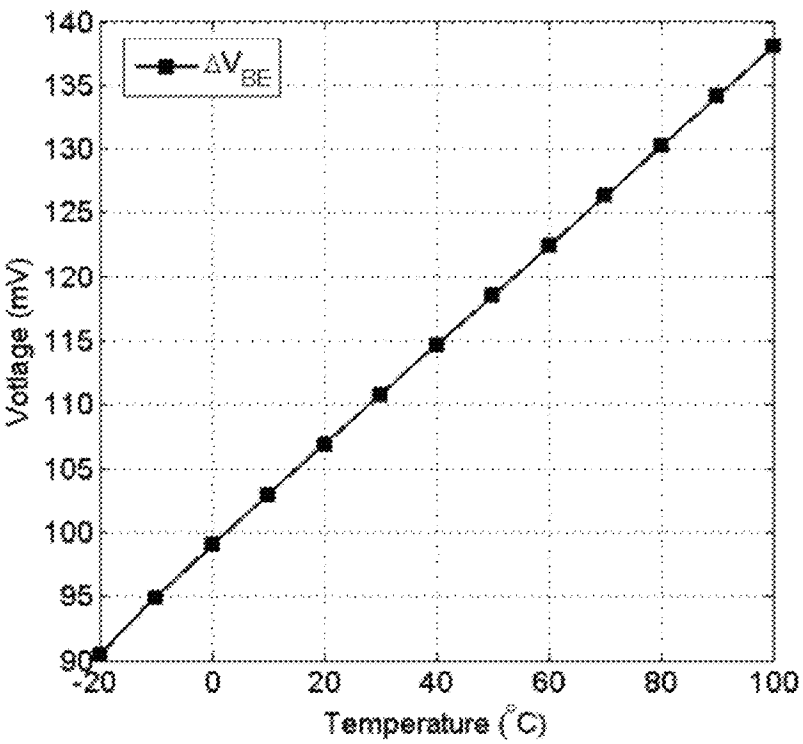

FIGS. 7A-7B present simulation results of the variation of $V_{BE}$ and $\Delta V_{BE}$ as a function of temperature that is generated from the bandgap voltage reference circuit of FIG. 4. FIG. 7A shows the temperature dependence of $V_{BE1}$ and $V_{BE2}$ where a CTAT behavior of both $V_{BE1}$ and $V_{BE2}$ with respect to temperature is observed. Conversely, FIG. 7B shows the temperature dependence of $\Delta V_{BE}$ where a PTAT behavior of $\Delta V_{BE}$ with respect to temperature is observed. The voltages of $V_{BE1}$, $V_{BE2}$ and $\Delta V_{BE}$ have been simulated using a $V_{in}$ of 0.4V. The weights of the voltages $V_{BE1}$ and $\Delta V_{BE}$ are added to generate the bandgap reference voltage. In some instances, the bandgap reference circuit shown in FIG. 4 can generate a bandgap reference voltage ($V_{REF}$) given by the following equation:

$$V_{REF}=a(V_{BE1}+b\Delta V_{BE}) \tag{2}$$

Where the constants a and b are involved in generating the weights for $V_{BE}$ and $\Delta V_{BE}$ to generate $V_{REF}$. Note that in other instances, a different summing circuit (e.g., summing circuit 432 shown in FIG. 4) using different values of $V_{BE1}$, $V_{BE2}$ and $\Delta V_{BE}$ can generate a different value for $V_{REF}$. The constants a and b in Eq. 2 above are defined or established by employing switched capacitor circuit techniques as opposed to the use of resistors that are typically used in known methods. In such known methods, the use of resistors increases the area of the circuit for low power or ULP devices. The power consumption of the bandgap reference circuit typically depends on the value of the resistor with typically larger resistors leading to lower power consumption. For example, the size of resistors typically involved in the design of a 200 nW bandgap reference circuit is approximately 14 MΩ. Resistors in the MΩ-sized range typically occupy a large physical area, a feature undesirable for low power or ULP devices. Additionally, for low power applications, large resistors are used in known bandgap reference circuits and such large resistors also increase the thermal and flicker noise for the bandgap reference circuit. The use of switched capacitor circuits, however, can define or establish such constants (e.g., a and b as shown in Eq. 2) with a significantly lower area.

The different voltage parameters described above (e.g., $V_{BE1}$, $V_{BE2}$ and $\Delta V_{BE}$) can be scalable, particularly for dynamic voltage scaling (DVS) applications. The bandgap reference voltage $V_{REF}$ discussed in Eq. 2 is also scalable where a and b are the constants used to produce a scalable bandgap reference voltage. In Eq. 2, one of the constants can be a natural number while the other constant a rational number. Note that the circuits used for physically scaling the different voltages $V_{BE1}$, $V_{BE2}$ and $\Delta V_{BE}$ are included within the summing circuit (e.g., summing circuit 432 shown in FIG. 4) of the reference generation circuit.

Figures 8A, 8B, 8C:
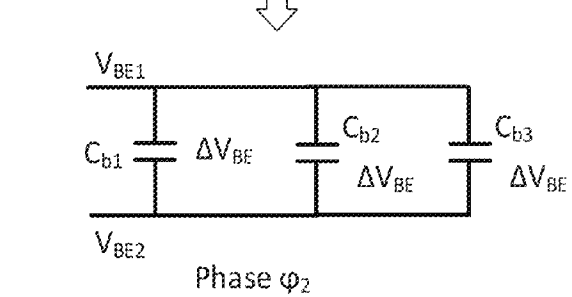
FIGS. 8A-C are schematic illustrations of different scaling circuits to scale $\Delta V_{BE}$, according to different embodiments.

FIGS. 8A-C are schematic illustrations of different scaling circuits to scale $\Delta V_{BE}$, according to different embodiments. As seen in FIG. 8A, the capacitor $C_b$ is connected between the nodes with the voltage of $V_{BE1}$ and $V_{BE2}$, respectively, that are generated from the switched capacitor charge pump based bandgap reference circuit as shown in FIG. 4 (i.e., voltage across capacitor $C_b$ is $\Delta V_{BE}$). For generating different bandgap reference voltages ($V_{REF}$), $\Delta V_{BE}$ has to be multiplied (or scaled) by different constants. The scaling circuits 800 presented in FIGS. 8A-C present ways to generate three alternate constants for $\Delta V_{BE}$, namely one (FIG. 8A), two (FIG. 8B) and three (FIG. 8C). FIG. 8A shows the circuit for generating $1*\Delta V_{BE}$, which is simply the portion of the charge-pump-based bandgap reference circuit shown in FIG. 4 with no additional signal modifications performed by the reference generation circuit. FIG. 8B shows the scaling circuit 800 for generating $2*\Delta V_{BE}$ that uses the two non-overlapping clock phases $\phi_1$ and $\phi_2$. In phase $\phi_2$, the voltages $V_{BE1}$ and $V_{BE2}$ are connected across the capacitors $C_{b1}$ and $C_{b2}$. In phase $\phi_1$, the connection of the capacitors are re-arranged and the top plate of $C_{b1}$ is connected to the bottom plate of $C_{b2}$ are shown in FIG. 8B. So the voltage appearing on the top plate of $C_{b2}$ is $2*\Delta V_{BE}$. This is a depiction of the voltage doubling scheme. Similarly, FIG. 8C shows the scaling circuit 850 for generating $3*\Delta V_{BE}$ that also uses the two non-overlapping clock phases $\phi_1$ and $\phi_2$. The functioning of the voltage tripling circuit 850 in FIG. 8C is similar to the voltage doubling circuit 800 shown in FIG. 8B. Note that varying the scaling circuit can allow scaling or multiplication of $\Delta V_{BE}$ by any integer value.

In some instances, the generation of multiple bandgap reference voltages can be involved for SoC applications to generate multiple $V_{DDS}$ values. In such instances, a $\Delta V_{BE}$ voltage can be selected based on the transistor Q2 as shown in FIG. 4. Subsequently, multiple scaled values of $\Delta V_{BE}$ can be generated as described above. This can complete half of the scaling involved in generating the appropriate $V_{REF}$ values according the Eq. 2. Subsequently, different fractional constant multipliers of $V_{BE}$ also can be generated to obtain the appropriate bandgap reference voltages ($V_{REF}$) for the SoC applications.

Figures 9A, 9B, 9C:
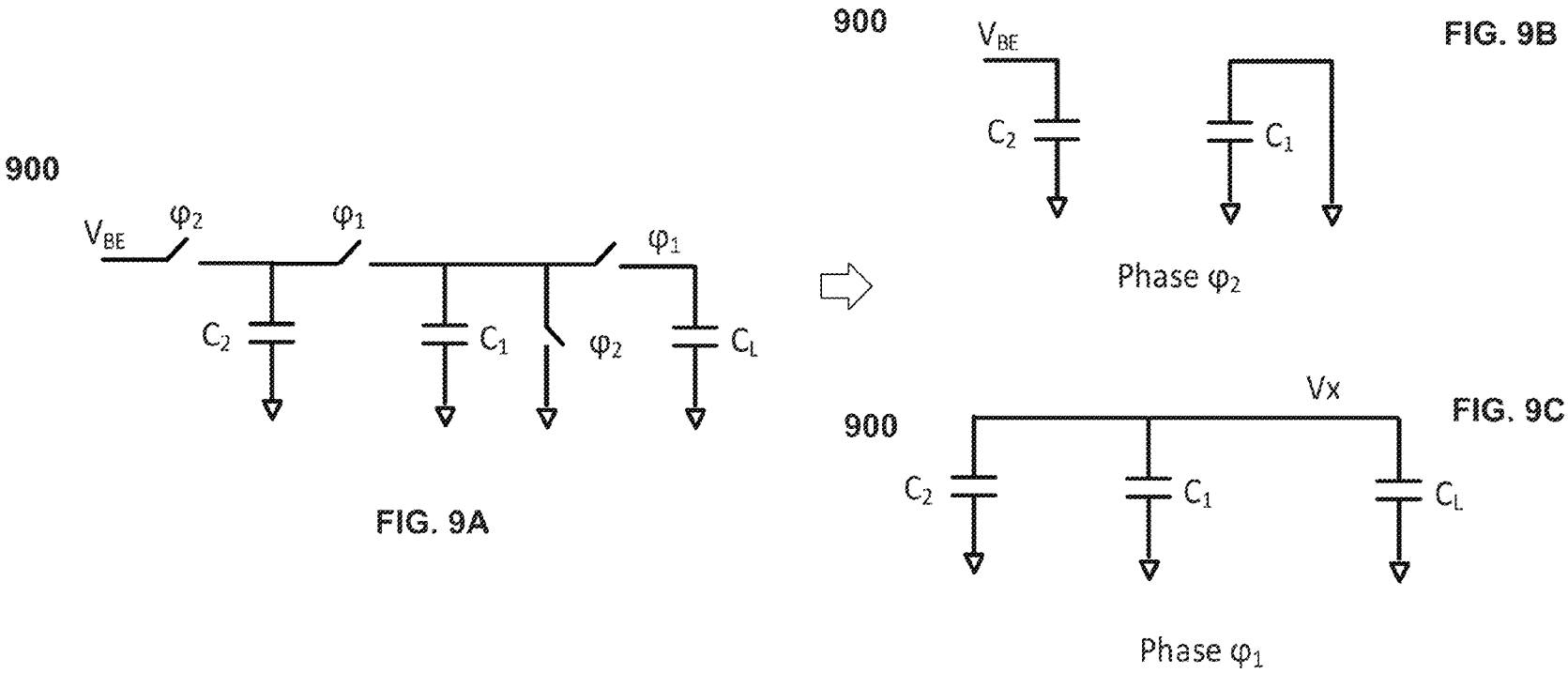
FIGS. 9A-C are schematic illustrations of different configurations of a scaling circuit to scale $V_{BE}$, according to an embodiment.

FIGS. 9A-C are schematic illustrations of different configurations of a scaling circuit to scale $V_{BE}$, according to an embodiment. Note that the scaling circuit 900 shown in FIGS. 9A-C will scale or multiply $V_{BE}$ with a fractional number (and not an integer). The scaling circuit 900 for $V_{BE}$ also includes switched capacitor circuits with non-overlapping clock phases $\phi_1$ and $\phi_2$. FIG. 9A shows the unloaded scaling circuit 900 for scaling $V_{BE}$ before clock phase signals have been applied. During operation in clock phase $\phi_2$ as shown in FIG. 9B, the capacitor $C_2$ is connected to $V_{BE}$, while the capacitor $C_1$ is connected to ground. Therefore the charge stored on capacitor $C_2$ is given by:

$$Q_2 = V_{BE} C_2 \tag{3}$$

In contrast, the charge stored on the capacitor $C_1$ is zero. During operation in clock phase $\phi_1$ as shown in FIG. 9C, the capacitors C1 and C2 are connected together and so the total charge on the capacitors remains the same. Therefore:

$$Q_2 = Q_{vx} \tag{4}$$

So, $$V_{BE} C_2 = V_{Xx}(C_1 + C_2) \tag{5}$$

Therefore $V_x$ is given by:

$$V_X = V_{BE} \frac{C_2}{C_1 + C_2} \tag{6}$$

Hence, by selecting the appropriate values of the capacitors $C_1$ and $C_2$, a value of $V_X$ is obtained that is a fraction of $V_{BE}$ as given by Eq. 6. The discussion presented herein in relation to FIGS. 8A-C and FIGS. 9A-C relate to scaling the voltages $V_{BE}$ and $\Delta V_{BE}$, respectively. Next, adding the scaled voltages $V_{BE}$ and $\Delta V_{BE}$ in the reference generation circuit to achieve the desired bandgap reference voltage value $V_{REF}$ is discussed.

Figure 10A:
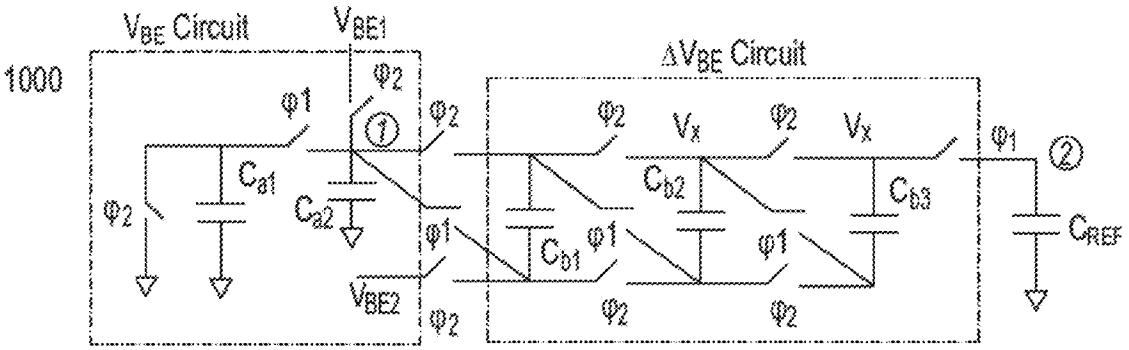
FIGS. 10A-C are schematic illustrations of a reference generation circuit for generating the bandgap reference voltage, according to an embodiment.
Figure 10B:
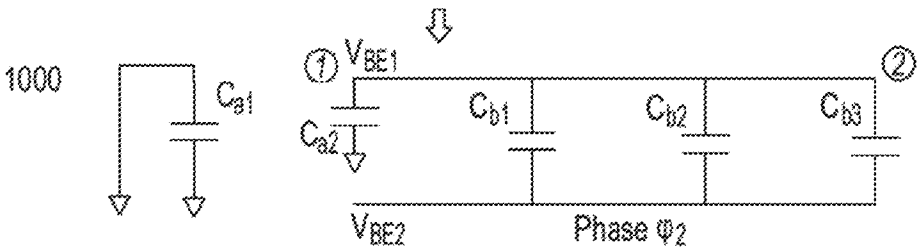
Figure 10C:
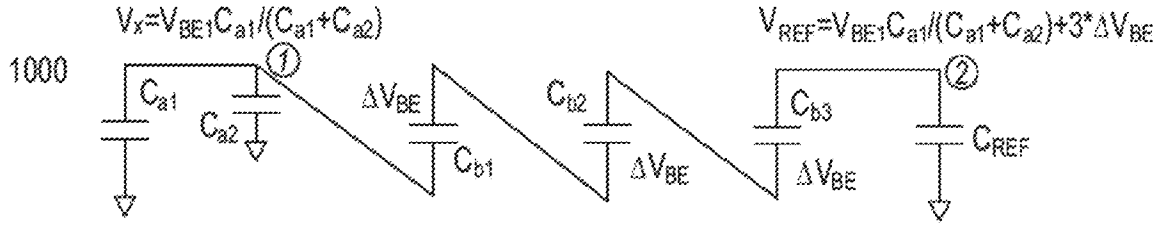

FIGS. 10A-C are schematic illustrations of a reference generation circuit for generating the bandgap reference voltage, according to an embodiment. The reference generation circuit 1000 includes the circuits used for generating constants for $V_{BE}$ and $\Delta V_{BE}$ as discussed in FIGS. 8A-C and FIGS. 9A-C and also uses the switched capacitor scheme to generate the desired bandgap reference voltage value $V_{REF}$. FIG. 10A shows the reference generation circuit 1000 (or summing circuit) with the appropriate signals. During operation in clock phase $\phi_2$, the switches connected with the (clock phase) signal $\phi_2$ are closed and the reference generation circuit 1000 is configured as shown in FIG. 10B. The capacitor $C_{a1}$ is discharged to the ground while the top plate of the capacitors $C_{a2}$, $C_{b1}$, $C_{b2}$, and $C_{b3}$ are connected to $V_{BE1}$. The bottom plate of the capacitor Ca2 is connected to ground, while the bottom plate of $C_{b1}$, $C_{b2}$, and $C_{b3}$ are connected to $V_{BE2}$. So, the voltage across $C_{a2}$ is $V_{BE1}$, while the voltage across $C_{b1}$, $C_{b2}$, and $C_{b3}$ is $\Delta V_{BE}$. During operation in clock phase $\phi_1$, the switches are reconfigured and the reference generation circuit 1000 is arranged as shown in FIG. 10C. First, the capacitors $C_{a1}$ and $C_{a2}$ are connected and charge shared to generate the $V_{BE}$ component of the bandgap reference voltage. The voltage at node 1 is given by:

$$V_1 = V_{BE1} \frac{C_{a2}}{C_{a1} + C_{a2}} \tag{7}$$

Additionally, during operation in clock phase $\phi_1$, the capacitors $C_{b1}$, $C_{b2}$, and $C_{b3}$ are rearranged to generate $3*\Delta V_{BE}$ between nodes 1 and 2 that leads to the generation of the desired bandgap reference voltage $V_{REF}$ as shown by:

$$V_{REF} = V_{BE1}\frac{C_{a2}}{C_{a1}+C_{a2}} + 3\Delta V_{BE} \quad (8)$$

Equation 8 shown above shows the generation of the proposed temperature independent bandgap reference voltage. It is to be noted that other values of $V_{REF}$ can be generated (or obtained) different values for the capacitors $C_{a1}$ and $C_{a2}$ and different scaling factors (or weights) for $\Delta V_{BE}$.

The bandgap reference circuit described in FIGS. 1-10 uses switched capacitor circuits that use two non-overlapping phases of a clock signal having a first clock phase $\phi_1$ and a second clock phase $\phi_2$. The clock signal is generated by a clock circuit (e.g., clock circuit 335 shown in FIG. 3) for the proper functioning of the bandgap reference circuit. The temperature independent bandgap reference voltage ($V_{REF}$) as described by Eq. 8 above is independent of clock frequency in the embodiments of the bandgap reference circuits presented in FIGS. 1-10. Hence, the power consumption of the clock circuit used to achieve $V_{REF}$ can be reduced or minimized by operating the clock circuit at a very low frequency. The frequency of the clock signal should, however, be high enough to maintain the bias voltage of BJT Q1 ($V_{BE1}$) and BJT Q2 ($V_{BE2}$) against leakage. Additionally, the frequency of the clock signal sent by the clock circuit varies inversely with the terminal voltage for the first BJT (e.g., Q1 in FIG. 4). Hence, a low frequency, low power clock circuit can be used to generate the desired temperature independent bandgap reference voltage ($V_{REF}$).

The different switches used in the bandgap reference circuits can pass a voltage equivalent to at least $V_{BE}$, which is a voltage higher than $V_{in}$. Therefore, the clock signals associated with clock phases $\phi_1$ and $\phi_2$ can sweep from 0 to $>V_{BE}$. If not, the voltage input at the gate terminal of a switch (e.g., an NMOS switch) is lower than the voltage value (or voltage level) that the switch has to pass, and the switch cannot pass the full voltage. Accordingly, because the switches in the bandgap reference circuit (e.g., switches in the summing circuit and the switched capacitor charge pumps) pass voltages up to $V_{BE}$, the clock signals (that drives the gate terminals of such switches) have voltages substantially equal to or higher than $V_{BE}$.

Figure 11:
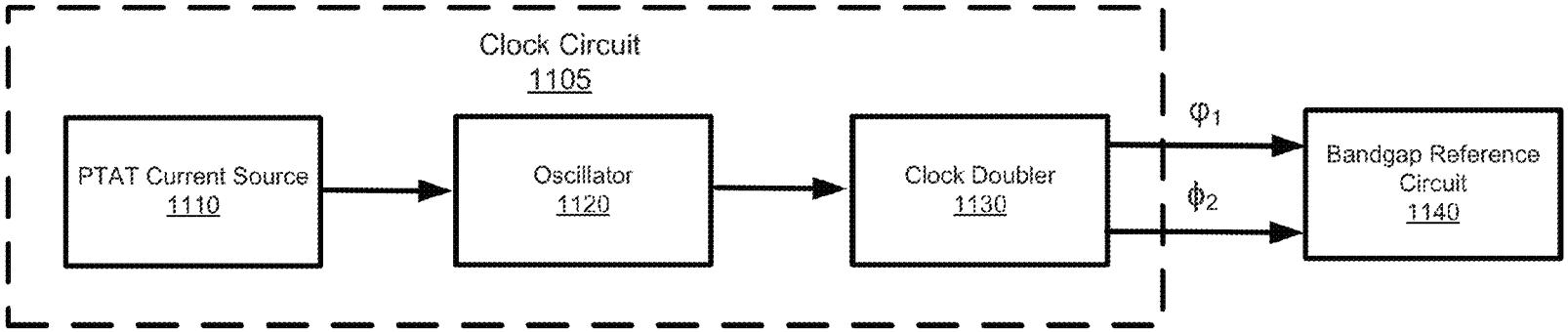
FIG. 11 shows the block diagram of a clock signal generation scheme for the bandpass reference voltage circuit, according to an embodiment.

FIG. 11 shows the block diagram of a clock signal generation scheme for the bandpass reference voltage circuit, according to an embodiment. The clock circuit 1105 is operably coupled to a bandgap voltage reference circuit 1140. The clock circuit 1105 includes an oscillator 1120 to provide the initial clock signal. The oscillator 1120 can be, for example, a current-controlled ring oscillator (e.g., that can produce clock signal of approximately 30 kHz at 0.4V $V_{in}$ and consume approximately 2 nW of power). In other configurations, the initial clock signal can be generated by, for example, an on-chip oscillator, a crystal oscillator (that is an electronic oscillator circuit that uses the mechanical resonance of a vibrating crystal of piezoelectric material to define an electrical signal with a very precise frequency), or any other appropriate clock source. The clock circuit 1105 also includes a PTAT current source 1110 and a clock doubler 1130. The PTAT current source 1110 can be the same source that supplies $V_{in}$ for the bandgap voltage reference circuit 1140. The clock doubler 1130 is used to double the voltage sweep range of the output clock signal to enable switches in the bandgap voltage reference circuit 1140 to pass at least a voltage level of $V_{BE}$ as discussed above. It is to be noted that the output clock signals from the clock doubler 1130 occur in two non-overlapping clock phases $\phi_1$ and $\phi_2$.

Figure 12:
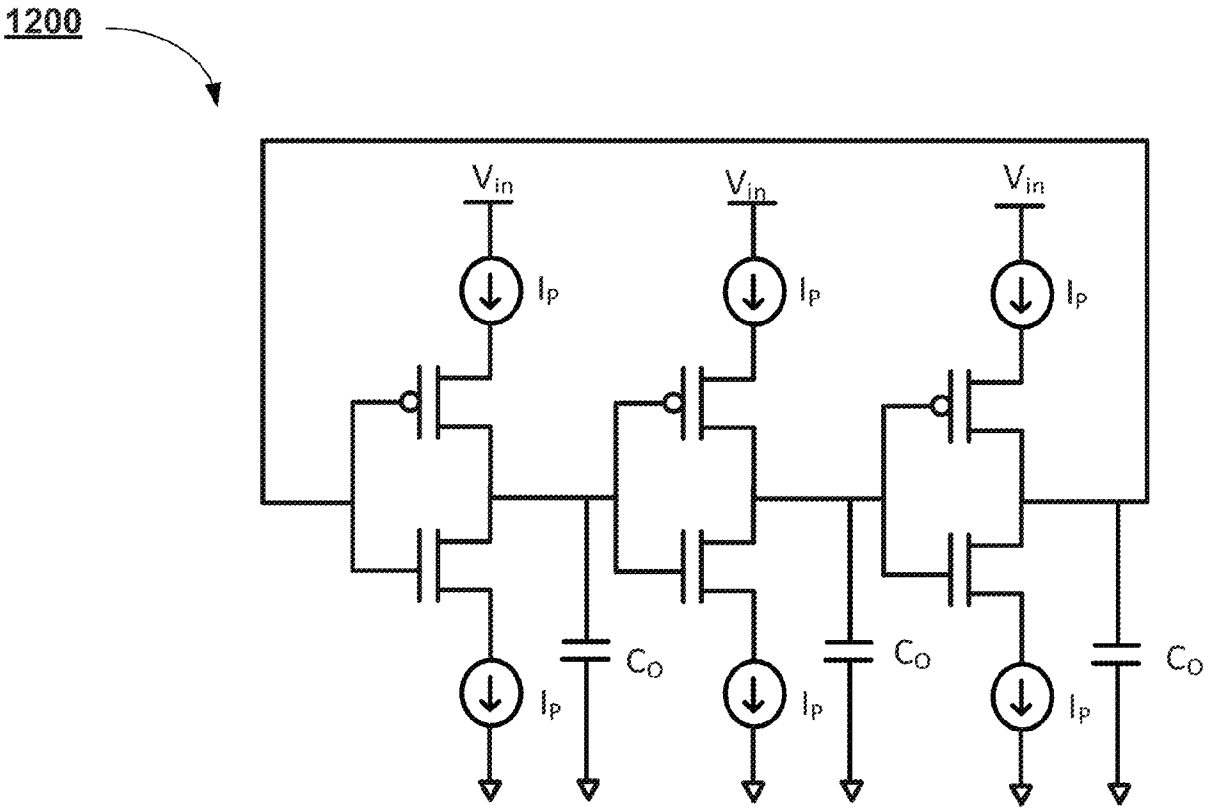
FIG. 12 is a schematic illustration of an oscillator shown in FIG. 11 that can be used to generate a clock signal for a bandgap reference circuit, according to an embodiment.

FIG. 12 is a schematic illustration of an oscillator shown in FIG. 11 that can be used to generate a clock signal for a bandgap reference circuit, according to an embodiment. In the example of FIG. 12, the oscillator is represented by a current-controlled ring oscillator circuit 1200. Referring to FIGS. 11-12, the current-controlled ring oscillator 1200 uses the current from the PTAT source 1110. This current increases with temperature but does not change with $V_{in}$. Because the power consumption of the PTAT current source 1110 increases with increasing $V_{in}$, the architecture of the current-controlled ring oscillator 1200 is such that the frequency of the of the clock signals decreases with increasing $V_{in}$ to keep the power consumption of the clock circuit 1105 low. This is because the delay of one inverter cell ($T_{R0}$) in the current-controlled ring oscillator is given by:

$$T_{R0} = \frac{C_0 V_{in}}{2I_0} \quad (9)$$

Therefore, the frequency of the ring oscillator is given by:

$$f_0 = \frac{1}{6T_{Ro}} = \frac{3I_0}{C_0 V_{in}} \quad (10)$$

Eq. (10) gives the expression of the output frequency ($f_0$) for the current controlled ring oscillator. The current $I_0$ used in Eq. 9 and 10 above comes from a PTAT current source (e.g., PTAT current source 1110 in FIG. 11), which remains constant with $V_{in}$ because of the high power supply rejection. Because the current $I_p$ within the current-controlled ring oscillator remains constant with $I_0$, Eq. (10) shows the output frequency of the current controlled ring oscillator ($f_0$) decreases with increasing $V_{in}$, which helps keep the power consumption of the bandgap voltage reference circuit low with increasing $V_{in}$.

Note that the current-controlled clock source (implemented by using a ring oscillator and the PTAT current source) as described in FIGS. 11-12 is a satisfactory choice to cater to a widely varying $V_{in}$ voltage to reduce or restrict power consumption. If, however, in some configurations, a clock source such as a crystal oscillator, a system clock, or a real time clock is already available on the device chip for other applications, then overall system power can be reduced by using such existing internal clock sources instead of generating a clock source for the bandgap voltage reference circuit as described above.

As described above, the clock circuit sends clock signals associated with clock phases $\phi_1$ and $\phi_2$ that sweep from 0V to a voltage greater than $V_{BE}$ to pass a voltage equivalent to at least $V_{BE}$ (which is a voltage higher than $V_{in}$) through a set of switches in the bandgap reference circuit (e.g., switched capacitor charge pump circuits, reference generation circuit, etc.) to generate the desired bandgap reference voltage ($V_{REF}$). This is because closing a switch to pass a voltage involves inherent voltage loss within the source-drain of the transistors of the switch. Hence, for passing a voltage of $V_{BE}$ through a switch, the clock signal has to sweep to a voltage value greater than $V_{BE}$. Otherwise if the input voltage at the gate terminal of a switch (e.g., an NMOS switch) is lower than the voltage value (or voltage level) that the switch has to pass, the switch cannot pass the full voltage ($V_{BE}$). As a result, in some instances, the clock signal being generated from the oscillator (e.g., oscillator 1120 in FIG. 11) undergoes signal boosting or enhancement (e.g., via a clock doubler) before being sent to the bandgap reference circuit as discussed in greater detail below.

Figure 13B:
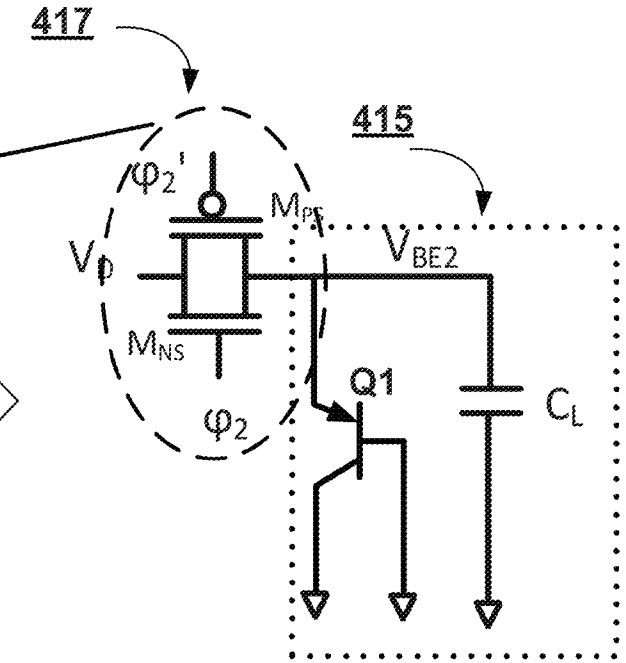
FIGS. 13A-B are schematic illustrations of an implementation of switches for the bandgap reference circuit shown in FIG. 4.
Figure 13A:
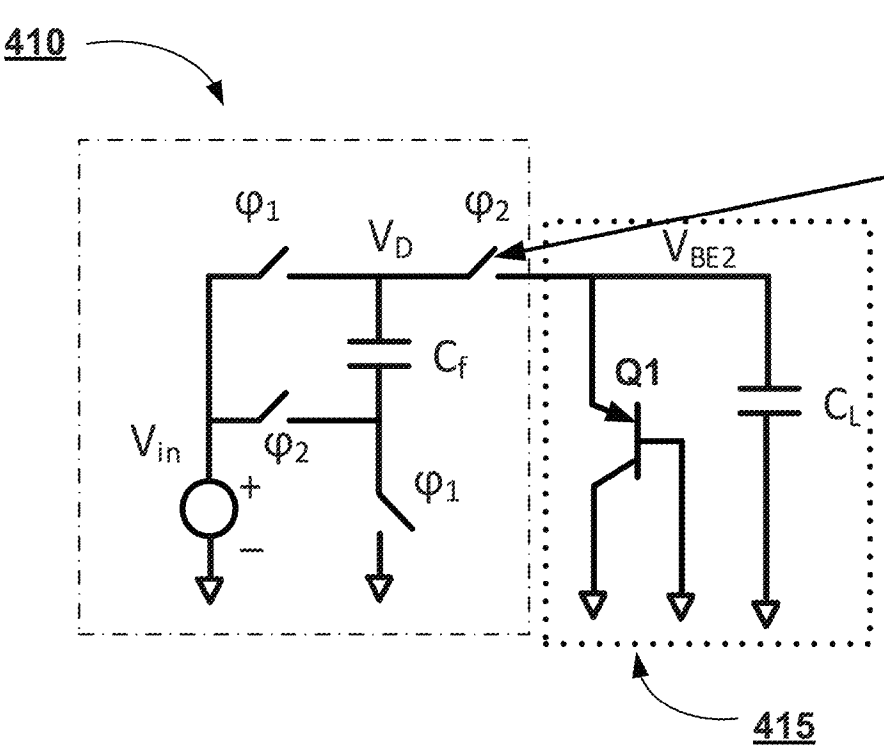

FIGS. 13A-B are schematic illustrations of an implementation of switches for the bandgap reference circuit shown in FIG. 4. FIG. 13A shows the switched capacitor charge pump circuit 410 in electrical connection with the base-emitter voltage clamp circuit 415 (that includes BJT Q1 and the capacitor $C_L$). FIG. 13B shows an implementation of one of the switch 417 associated with the clock phase signal $\phi_2$. The switch 417 is implemented using a transmission gate including transistors (metal-oxide field effect transistors (MOSFETs)) $M_{NS}$ and $M_{PS}$. In some embodiments, the voltage $V_{BE2}$ is typically clamped by the BJT Q1 around 0.7-0.8V. In some embodiments, a clock phase signal $\phi_2$ running on the magnitude $V_{in}$ cannot be used to close the switch 417. In such embodiments, the clock phase signal $\phi_2$ swings to a magnitude of at least $2*V_{in}$ to enable the transmission gate to pass the terminal voltage $V_D$ properly into $V_{BE2}$ (because of inherent losses within source-drain of the transistors $M_{NS}$ and $M_{PS}$ within the transmission gate). Therefore, in such instances, a clock doubling circuit is implemented to convert a clock phase signal that swings from 0 to $V_{in}$ into a clock phase signal that swings from $0>V_{BE2}$ (e.g., $2*V_{in}$ in this example).

Figure 14A:
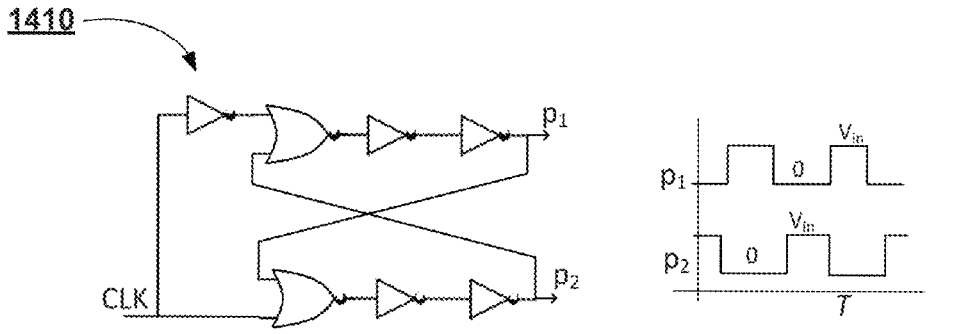
FIGS. 14A-C are schematic illustrations of the steps involved in implementing a clock doubling technique to generate clock signals at different phases, according to an embodiment.
Figure 14B:
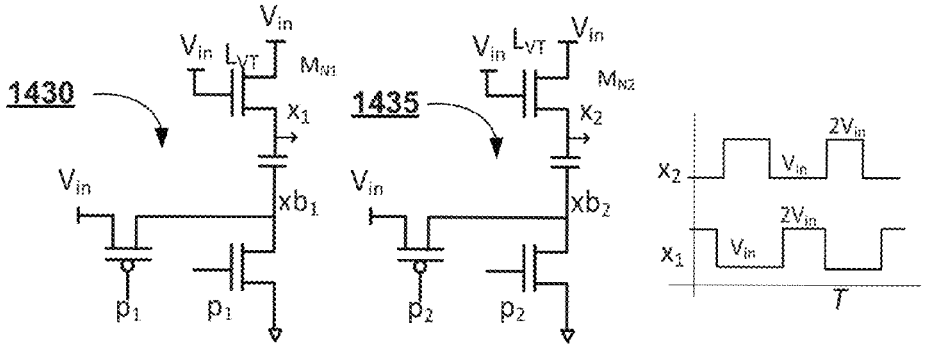
Figure 14C:
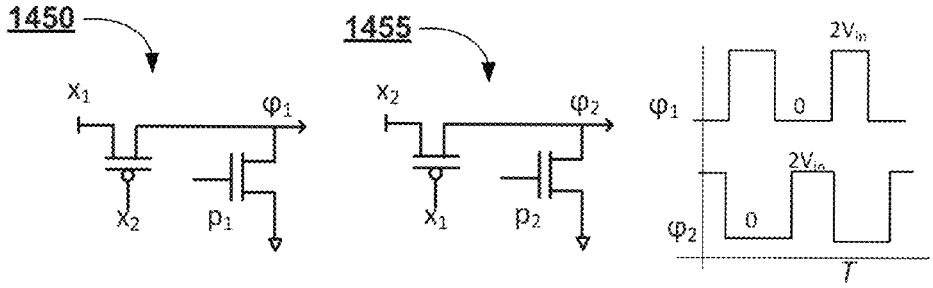

FIGS. 14A-C are schematic illustrations of the steps involved in implementing a clock doubling technique to generate clock signals at different phases that swings from 0 to $2V_{in}$, according to an embodiment. The steps involved in clock doubling as shown in FIGS. 14A-C are implemented in the clock doubler of the clock circuit (e.g., clock doubler 1130 shown in the FIG. 11). FIG. 14A shows a first circuit portion 1410 that can generate non-overlapping clock phase signals. In FIG. 14A, the first circuit portion 1410 receives from an on-chip clock a clock signal (e.g., CLK) having an input voltage. The first circuit portion 1410 produces a first clock phase signal (e.g., $p_1$) having a minimal voltage (e.g., 0) and a maximum voltage (e.g., $V_{in}$). Similarly, the first circuit portion 1410 also produces a second clock phase signal (e.g., $p_2$) that is non-overlapping with the first clock phase signal and having a minimal voltage (e.g., 0) and a maximum voltage (e.g., $V_{in}$). Said in another way, the first circuit portion generates two non-overlapping signals that swing from 0 to $V_{in}$. The signals $p_1$ and $p_2$ can be seen as being non-overlapping because at any time (i.e., during any T) when the signal $p_1$ has an amplitude of zero, the signal $p_2$ has an amplitude of $V_{in}$.

The signals p1 and p2 will be used to generate new signals that swing from $V_{in}$ to $2V_{in}$ using the second circuit portion as shown in FIG. 14B. In FIG. 14B, a second circuit portion (represented in FIG. 14B as two sub-portions 1430 and 1435) is operatively coupled to the first circuit portion 1410, where the second circuit portion 1430 and 1435 includes a set of capacitors and a set of invertors that are collectively configured to output a third clock phase signal (e.g., signal represented at $x_1$) and a fourth clock phase signal (e.g., signal represented at $x_2$). The third clock phase signal (e.g., $x_1$) and the fourth clock phase signal (e.g., $x_2$) each has a minimal voltage (e.g., $V_{in}$) that is greater than the minimum voltage of the first clock phase signal (e.g., 0) and the minimal voltage of the second clock phase signal (e.g., 0). Additionally, the third clock phase signal ($x_1$) and the fourth clock phase signal ($x_2$) each has a maximum voltage (e.g., $2V_{in}$) that is greater than the maximum voltage of the first clock phase signal ($V_{in}$) and the maximum voltage of the second clock phase signal ($V_{in}$). In FIG. 14B, the node $xb_1$ (shown in sub-portion 1430) and the node $xb_2$ (shown in sub-portion 1435) are the output of inverters running on $V_{in}$ and thus the voltage at nodes $xb_1$ and $xb_2$ swing from 0 to $V_{in}$. Node $x_1$ (in sub-portion 1430) and node $x_2$ (in sub-portion 1435) are connected through diode-connected NMOS transistors to a capacitor. The transistors used are low threshold voltage ($L_{VT}$) transistors, and hence in the absence of a load, nodes $x_1$ and $x_2$ will charge to $V_{in}$, because the $L_{VT}$ transistors have high leakage. Furthermore, the bottom plate of the capacitors connected to node $x_1$ and $x_2$ swing from 0 to $V_{in}$. Therefore, the top plate of such capacitors will swing from $V_{in}$ to $2V_{in}$ resulting in the signals represented at $x_1$ and at $x_2$ respectively in the chart of FIG. 14B.

The signals represented at $x_1$ and at $x_2$ respectively in FIG. 14B are transformed into signals that can swing from 0 to $2*V_{in}$ using the third circuit portion shown in FIG. 14C. In FIG. 14C, a third circuit portion (represented in FIG. 14C as two sub-portions 1450 and 1455) is operatively coupled to the second circuit portion (1430 and 1435 in FIG. 14B). The third circuit portion 1450 and 1455 includes a set of transistors that can output a fifth clock phase signal (e.g., represented as $\phi_1$) and a sixth clock phase signal (e.g., represented as $\phi_2$). Furthermore, the fifth clock phase signal ($\phi_1$) and the sixth clock phase signal ($\phi_2$) each has a minimal voltage substantially equal to the minimum voltage of the first clock phase signal (0) and the minimal voltage of the second clock phase signal (0), and the fifth clock phase signal ($\phi_1$) and the sixth clock phase signal ($\phi_2$) each have a maximum voltage ($2*V_{in}$) substantially equal to the maximum voltage of the third clock phase signal ($x_1$) ($2*V_{in}$) and the maximum voltage of the fourth clock phase signal ($x_2$) ($2*V_{in}$). In FIG. 14C, in the third circuit sub-portion 1450, when the voltage at $p_1$ is high, the voltage at $x_2$ is also high, and thus the net voltage of the phase signal ($\phi_1$) is pulled down to ground. When the voltage at $p_1$ is zero, the voltage at $x_2$ is low at $V_{in}$. At this time, the voltage at $x_1$ is at $2*V_{in}$. At this time the PMOS transistor turns on and passes the $x_1$ voltage level to the clock phase signal $\phi_1$. As a result, the clock phase signal $\phi_1$ swings from 0 to $2*V_{in}$. Similarly, the clock phase signal $\phi_2$ also swings from 0 to $2*V_{in}$ in a non-overlapping manner as shown in the chart in FIG. 14C.

Figure 15A:
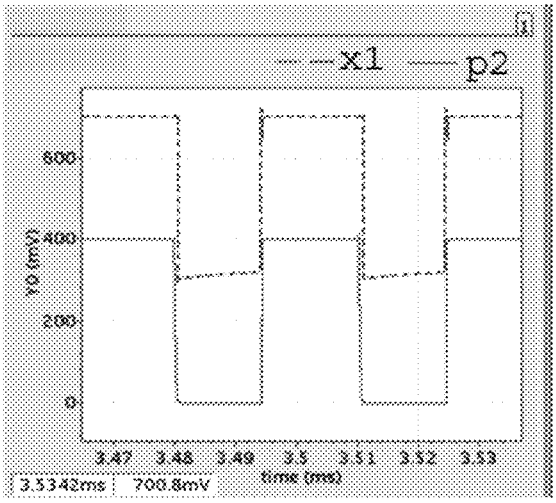
FIGS. 15A-B present the results of simulations of an example of a clock doubler circuit that sends boosted clock phase signals to a bandgap voltage reference circuit.
Figure 15B:
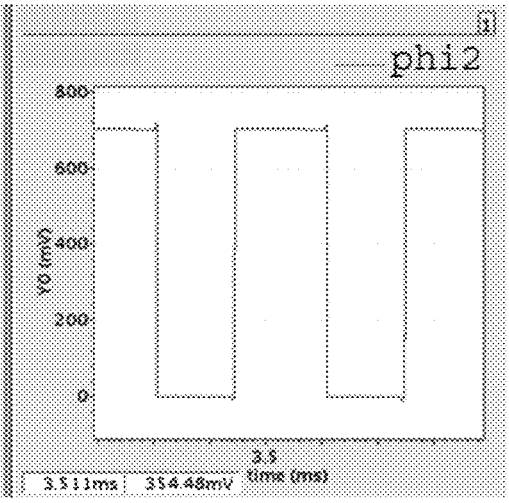

FIGS. 15A-B present the results of simulations of an example of a clock doubler circuit that sends boosted clock phase signals to a bandgap voltage reference circuit. FIG. 15A shows that the signal $p_2$ (similar to the phase signal p2 in FIG. 14A) swings from 0 to 400 mV in time (i.e., swings from 0 to $V_{in}$). FIG. 15A also shows that the signal $x_1$ (similar to the phase signal $x_1$ in FIG. 14B) swings from 350 mV to 750 mV in time (i.e., approximately swings from $V_{in}$ to $2*V_{in}$). FIG. 15 B shows that the signal $phi_2$ (similar to the phase signal $\phi_2$ in FIG. 14C) swings from 0 to 750 mV in time (i.e., approximately swings from 0 to $2*V_{in}$).

Referring to FIGS. 3, 4 and 14, in some configurations of a bandgap voltage reference circuit system, a first switched capacitor charge pump (e.g., switched capacitor charge pump 410 in FIG. 4) (or simply a first charge pump) is operatively coupled to the clock circuit (e.g., clock circuit 335 in FIG. 3) and a first BJT of the bandgap reference circuit (e.g. BJT Q1 in FIG. 4). In such configurations, the first switched capacitor charge pump can receive the fifth clock phase signal (e.g., clock phase signal $\phi_1$ in FIG. 14C) and the sixth clock phase signal (e.g., clock phase signal $\phi_2$ in FIG. 14C) and output a voltage driving the terminal of the first BJT (e.g. BJT Q1 in FIG. 4). Similarly, in such configurations, a second switched capacitor charge pump (e.g., switched capacitor charge pump 420 in FIG. 4) (or simply a second charge pump) is operatively coupled to the clock circuit (e.g., clock circuit 335 in FIG. 3) and a second BJT of the bandgap reference circuit (e.g. BJT Q2 in FIG. 4). In such configurations, the second switched capacitor charge pump can receive the fifth clock phase signal (e.g., clock phase signal $\phi_1$ in FIG. 14C) and the sixth clock phase signal (e.g., clock phase signal $\phi_2$ in FIG. 14C) and output a voltage driving the terminal of the first BJT (e.g. BJT Q1 in FIG. 4).

Also referring to FIGS. 3, 4 and 14, the clock circuit (e.g., clock circuit 335 in FIG. 3) sends a clock signal with a specific frequency to the bandgap voltage reference circuit (e.g., bandgap voltage reference circuit 305 in FIG. 3). In such configurations, a first switched capacitor charge pump (e.g., switched capacitor charge pump 410 in FIG. 4) (or simply a first charge pump) is operatively coupled to the clock circuit (e.g., clock circuit 335 in FIG. 3) and a first BJT of the bandgap reference circuit (e.g. BJT Q1 in FIG. 4). In such configurations, the first switched capacitor charge pump can output a voltage (i.e., voltage at node A in FIG. 4) driving the terminal of the first BJT based on the fifth clock phase signal (e.g., clock phase signal $\phi_1$ in FIG. 14C) and the sixth clock phase signal (e.g., clock phase signal $\phi_2$ in FIG. 14C), where the frequency of the fifth clock phase signal and the sixth clock phase signal varies inversely with the input voltage of the first BJT (i.e., voltage at node A in FIG. 4). Similarly, in such configurations, a second switched capacitor charge pump (e.g., switched capacitor charge pump 420 in FIG. 4) (or simply a second charge pump) is operatively coupled to the clock circuit (e.g., clock circuit 335 in FIG. 3) and a second BJT of the bandgap reference circuit (e.g. BJT Q2 in FIG. 4). In such configurations, the second switched capacitor charge pump can output a voltage (i.e., voltage at node B in FIG. 4) driving the terminal of the second BJT based on the fifth clock phase signal (e.g., clock phase signal $\phi_1$ in FIG. 14C) and the sixth clock phase signal (e.g., clock phase signal $\phi_2$ in FIG. 14C), where the frequency of the fifth clock phase signal and the sixth clock phase signal varies inversely with the input voltage of the second BJT (i.e., voltage at node B in FIG. 4).

Figure 16:
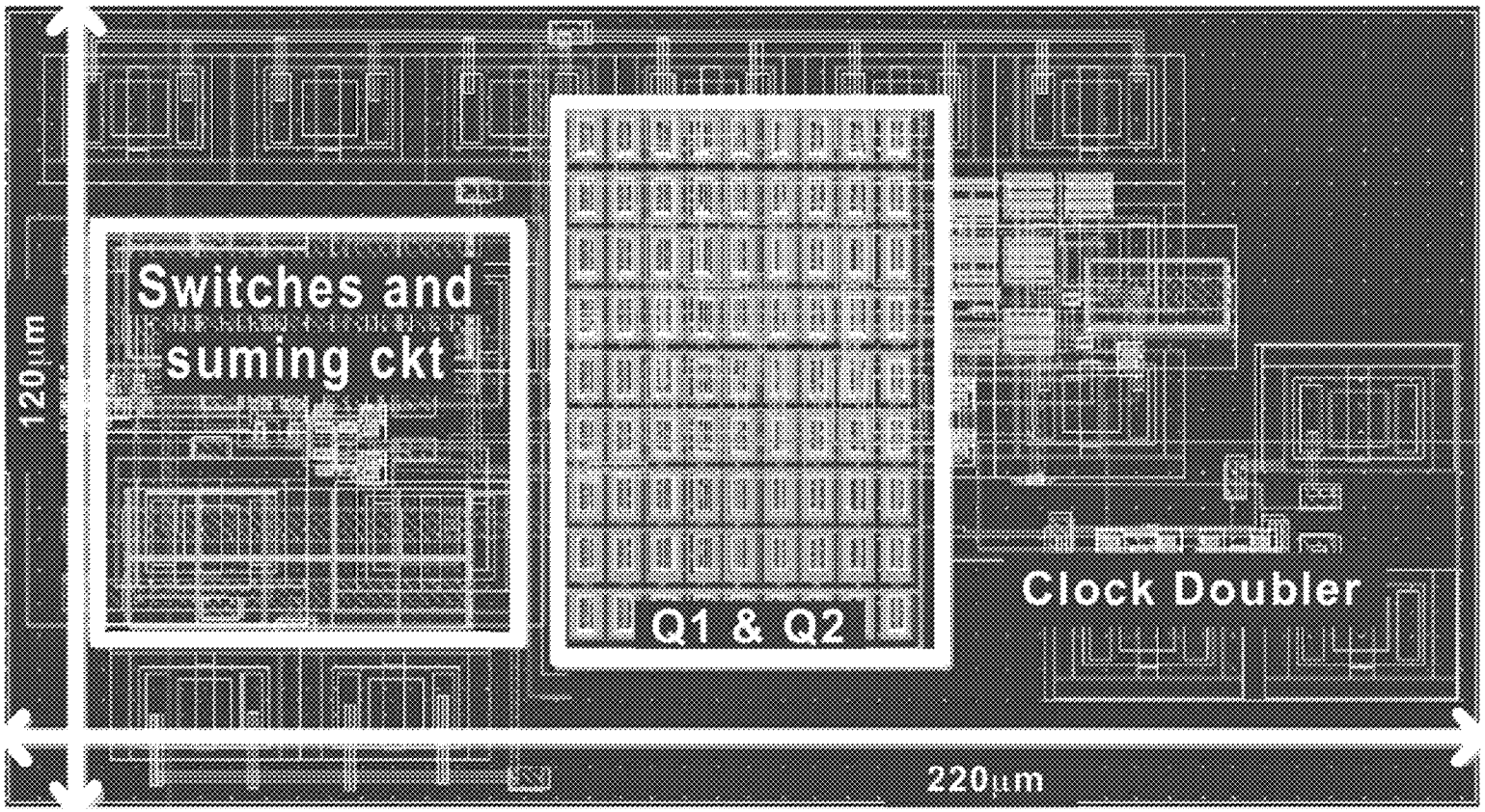
FIG. 16 shows the annotated lay out of a bandgap reference circuit, according to an embodiment.

FIG. 16 shows the annotated lay out of the complete bandgap reference circuit, according to an embodiment. The bandgap voltage reference circuit shown in FIG. 16 has an area of 0.0264 $mm^2$ and can be implemented, for example, in a commercial bulk 130 nm complementary metal-oxide-semiconductor (CMOS) process or other types of suitable technologies. The capacitors are implemented using nMOS (or n-channel MOSFET) capacitors and metal-insulator-metal (MIM) capacitors. The load capacitors for the $V_{BE}$ generation circuit and the $V_{BE}$ fraction generation switched capacitor circuit (see circuits in FIG. 9) were implemented using nMOS capacitors, whereas the load capacitors for the bandgap output generation (see circuit in FIG. 10) and the $\Delta V_{BE}$ doubling circuit (see circuit in FIG. 8) were implemented using MIM capacitors to avoid bottom plate capacitor parasitics. The total area of the bandgap voltage reference circuit as shown in FIG. 16 is significantly smaller than known low power bandgap reference circuits because the bandgap voltage reference circuit shown in FIG. 16 does not use large resistors. The bandgap voltage reference circuit shown in FIG. 16 also consumes 19.2 nW of power at 0.4V $V_{in}$, which is an order of magnitude lower than the power used in known non-duty-cycled bandgap reference circuits.

Figure 17:
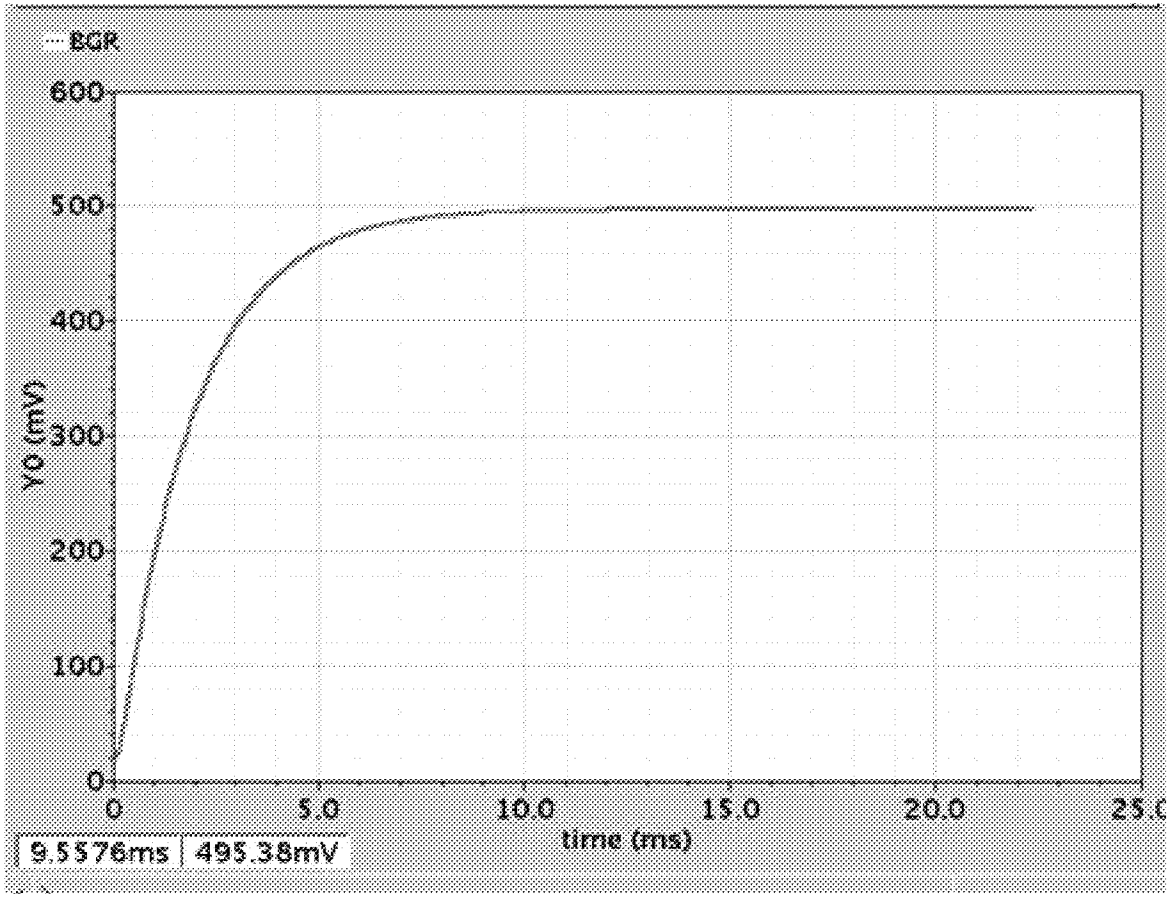
FIG. 17 is a graphical display of an example of the transient behavior of a bandgap reference circuit at startup.

Because the bandgap reference circuit is a switching capacitor circuit, the bandgap reference circuit has a settling time at startup. FIG. 17 is a graphical display of an example of the transient behavior of a bandgap reference circuit at start-up. FIG. 17 shows the bandgap reference circuit takes 15 msec to settle at a 0.8V $V_{in}$. At 0.4V, the settling time is 90 msec. The settling time is directly dependent on the clock frequency and the power supply $V_{in}$. In some configurations, the settling time for the bandgap reference circuit can be large. In such configurations, a fast start-up mode for the bandgap reference circuit can be implemented. In such configurations, during the fast start-up mode, the clock frequency can be made several times faster than during a normal operational mode, which can reduce the settling time of the bandgap reference circuit. This can be done during power on the fast start-up mode, where the current source of the clock source (e.g., clock circuit 335 in FIG. 3) is increased several times which then increases the clock frequency. A settling time of 20 μs during startup of the bandgap reference circuit can be used in the fast start-up mode.

Figure 18:
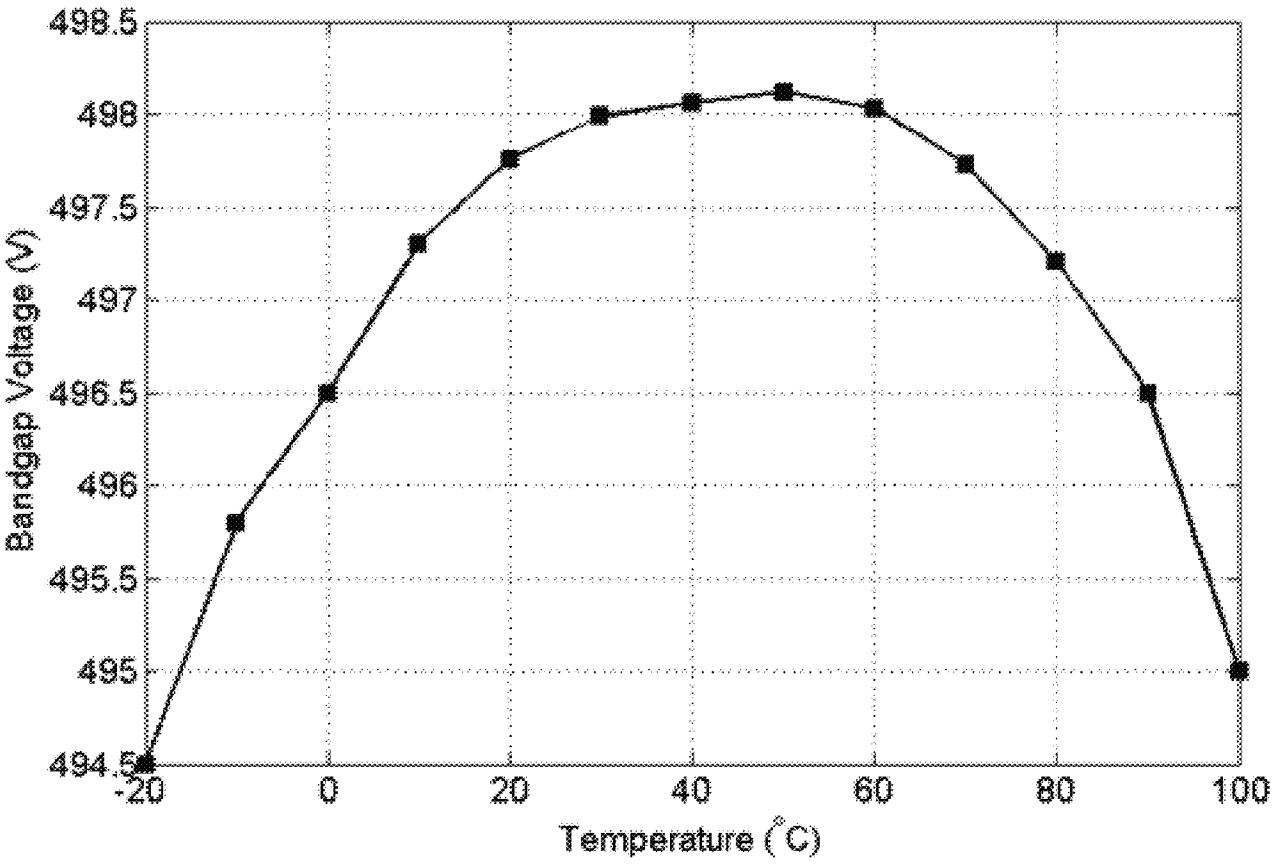
FIG. 18 shows the simulated variation of an embodiment of a bandgap reference circuit output for a temperature range of −20° C. to 100° C.

An embodiment of the bandgap reference circuit was verified for proper functionality in the temperature range of −20° C. to 100° C. While this range is quite large for the intended ULP applications, the performance of the bandgap reference circuit in this range is relevant as it compares with known state-of-the-art bandgap reference circuits. FIG. 18 shows the simulated variation of an embodiment of a bandgap reference circuit output for a temperature range of −20° C. to 100° C. The bandgap reference circuit can provide an output voltage of 500 mV and the output voltage varies by 3 mV over a temperature variation of 120° C., thus achieving a performance of 50 ppm/° C. The performance of such a bandgap reference circuit with temperature as shown in FIG. 20 is in line with known technologies and an improved performance can be achieved at a higher output voltage (i.e., output voltage >500 mV).

Figure 19:
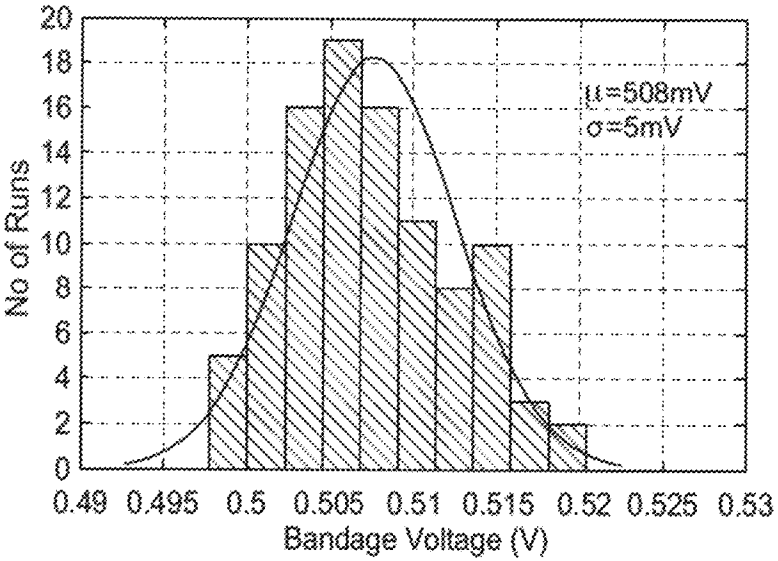
FIG. 19 presents the results of a Monte-Carlo simulation that shows an example of the change in bandgap reference output with respect to process and mismatch variation.

FIG. 19 presents the results of a Monte-Carlo simulation that shows an example of the change in bandgap reference output with respect to process and mismatch variation. FIG. 19 shows the untrimmed output of the bandgap reference circuit, where the output achieves a mean (μ) of 508 mV and a standard deviation (σ) of 5 mV. The untrimmed output of the bandgap reference circuit also shows a 3σ variation of <3%. The variation in the output (voltage) shown in FIG. 19 can be reduced by trimming the bandgap output using the capacitors used in the switched capacitor circuits (see FIGS. 8-10) to generate the appropriate constants for the bandgap reference output.

Figure 20:
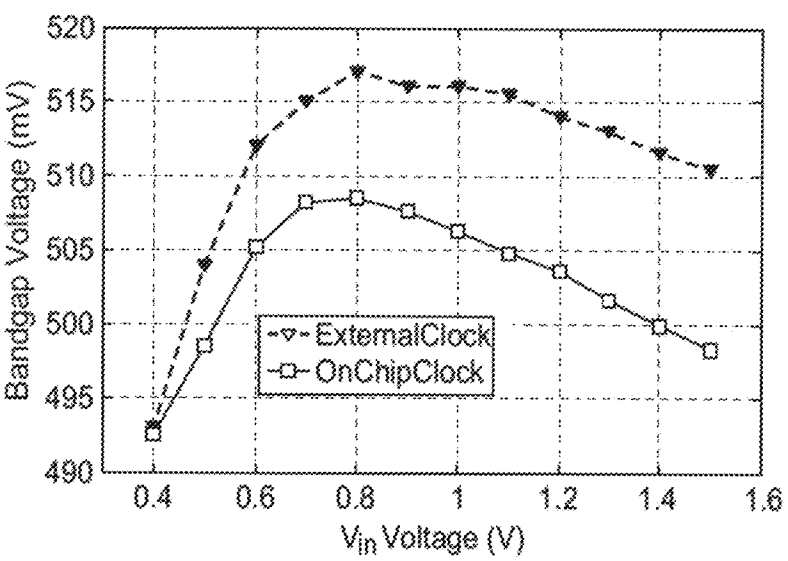
FIG. 20 presents the results of a simulation that shows an example of the change in bandgap reference voltage with respect to variation with input voltage ($V_{in}$).

FIG. 20 presents the results of a simulation that shows an example of the change in bandgap reference voltage with respect to variation with input voltage ($V_{in}$). FIG. 20 shows the variation of input voltage ($V_{in}$) from two separate sources, namely an external clock and an on-chip clock. FIG. 20 shows that the bandgap reference voltage varies by approximately 4% when an external constant clock source is used to deliver $V_{in}$, and the bandgap reference voltage varies by approximately 2% when an on-chip cock is used to deliver $V_{in}$. Thus the use of an on-chip clock as discussed in the specifications thus far reduces the bandgap reference circuit output variance by approximately 50%.

The bandgap reference circuit discussed herein operates from a minimum input voltage of 0.4V, thus improving over two-fold from the known bandgap reference circuits. The power consumption of the proposed bandgap reference circuit is 19.2 nW, which is over nine-fold lower than achieved without duty cycling in known bandgap reference circuits. Known bandgap reference circuits typically achieve a low power of 170 nW by sampling the reference voltage on a capacitor by periodically turning it on and off. Duty cycling can be applied to one or more bandgap reference circuit embodiments described herein as well to further lower power. The power supply variation can be higher in the one or more bandgap reference circuit embodiments described herein because the architecture does not use external current sources, which are typically used in known architectures. The lower area of the bandgap reference circuit (0.0264 $mm^2$) is also achieved because large resistors are not used.

Note that the BJT's used in the bandgap reference circuit discussed above has been shown to be a PNP BJT as an example only, and not a limitation. In other configurations, the BJT's used in the bandgap reference circuit can be an NPN BJT(s). In such configurations (i.e., during use of an NPN BJT(s)), the bandgap reference circuit can generate a temperature insensitive bandgap reference voltage ($V_{REF}$) using an input (supply) voltage that is lower than the base-emitter voltage ($V_{BE}$) of the NPN BJT. Note the term base-emitter voltage ($V_{BE}$) is intended to cover both the base-emitter voltage for an NPN BJT and the emitter-base voltage for a PNP BJT. The bandgap reference circuits described thus far can be implemented using both PNP BJT's as well as NPN BJT's. Furthermore, the bandgap reference circuits using PNP BJT's can be fabricated using a CMOS process, and the bandgap reference circuits using NPN BJT's can be fabricated using biCMOS or other processes.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above. Likewise, the various diagrams may depict an example architectural or other configuration for the invention, which is done to aid in understanding the features and functionality that can be included in the invention. The invention is not restricted to the illustrated example architectures or configurations, but can be implemented using a variety of alternative architectures and configurations. Additionally, although the invention is described above in terms of various exemplary embodiments and implementations, it should be understood that the various features and functionality described in one or more of the individual embodiments are not limited in their applicability to the particular embodiment with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described exemplary embodiments.

What is claimed is:

1. An apparatus, comprising:

a bandgap reference circuit having:

a first bipolar junction transistor (BJT) configured to generate a base emitter voltage of the first BJT based on a first input voltage of the first BJT that is lower than the base emitter voltage of the first BJT, the first input voltage being generated by a first charge pump;

a second bipolar junction transistor (BJT) having a device width greater than a device width of the first BJT, the second BJT configured to generate a base emitter voltage of the second BJT based on a second input voltage of the second BJT that is lower than the base emitter voltage of the second BJT, the second input voltage being generated by a second charge pump; and a reference generation circuit operatively coupled to the first BJT and the second BJT, the reference generation circuit configured to generate a bandgap reference voltage based on the base emitter voltage of the first BJT and the base emitter voltage of the second BJT.

2. The apparatus of claim 1, wherein:

the first BJT is configured to receive the first input voltage for the first BJT from a first power supply without generation of a first intermediate voltage that is higher than the base emitter voltage of the first BJT, the second BJT is configured to receive the second input voltage for the second BJT from a second power supply without generation of a second intermediate voltage that is higher than the base emitter voltage of the second BJT.

3. The apparatus of claim 1, wherein:

the first BJT is operatively coupled to the first charge pump circuit via at least a first capacitor, the second BJT is operatively coupled to the second charge pump circuit via at least a second capacitor.

4. The apparatus of claim 1, further comprising:

a clock circuit operatively coupled to the bandgap reference circuit;

the bandgap reference circuit further having:

the first charge pump circuit operatively coupled to the first BJT and the clock circuit, the first charge pump circuit configured to receive the first input voltage of the first BJT and to output the base emitter voltage of the first BJT, the first input voltage for the first charge pump circuit being less than the first input voltage of the first BJT; and the second charge pump circuit operatively coupled to the second BJT and the clock circuit, the second charge pump configured to receive the second input voltage of the second BJT and to output the base emitter voltage of the second BJT, the second input voltage for the second charge pump circuit being less than the second input voltage of the second BJT.

5. The apparatus of claim 1, further comprising:

a clock circuit operatively coupled to the bandgap reference circuit, the clock circuit configured to send a clock signal having a frequency;

the frequency of the clock signal sent by the clock circuit varying inversely with the first input voltage of the first BJT.

6. The apparatus of claim 1, further comprising:

a clock circuit operatively coupled to the bandgap reference circuit, the clock circuit configured to send a clock signal having a first clock phase and a second clock phase, the bandgap reference circuit further having:

the first charge pump circuit operatively coupled to the first BJT and the clock circuit, the first charge pump having a first configuration when receiving the first clock phase of the clock signal and a second configuration when receiving the second clock phase of the clock signal, the first charge pump configured to output the base emitter voltage of the first BJT based on a first charge stored at a first capacitor during the first configuration and the second configuration of the first charge pump, the second charge pump circuit operatively coupled to the second BJT and the clock circuit, the second charge pump having a first configuration when receiving the first clock phase of the clock signal and a second configuration when receiving the second clock phase of the clock signal, the second charge pump configured to output the base emitter voltage of the second BJT based on a second charge stored at a second capacitor during the first configuration and the second configuration of the second charge pump.

7. The apparatus of claim 1, wherein:

the reference generation circuit has a plurality of switched capacitors without including or being operatively coupled to a current mirror that sources current from a node at a voltage higher than (1) the base emitter voltage of the first BJT, and (2) the base emitter voltage of the second BJT.

8. The apparatus of claim 1, wherein:

the reference generation circuit includes a capacitor operatively coupled to a first BJT and a second BJT, the capacitor storing a difference of the base emitter voltage of the first BJT and the base emitter voltage of the second BJT when the first BJT and the second BJT are operating.

9. The apparatus of claim 1, wherein:

the reference generation circuit has a first configuration and a second configuration, the reference generation circuit in the first configuration having a plurality of switched capacitors in a first arrangement to define a first scaled base emitter voltage based on the base emitter voltage of the first BJT, which decreases with temperature, and a capacitance of each capacitor from the plurality of capacitors, the reference generation circuit in the second configuration having the plurality of switched capacitors in a second arrangement to define a second scaled difference voltage based on the base emitter voltage of the second BJT, which increases with temperature, and the capacitance of each capacitor from the plurality of capacitors, the bandgap reference voltage being substantially constant and based on the scaled base emitter voltage and the scaled difference voltage, when the bandgap reference circuit is operational.

10. An apparatus, comprising:

a reference generation circuit including:

a base-emitter fractional voltage generation circuit having:

a first capacitor connected to a bipolar junction transistor (BJT) and configured to receive a base emitter voltage from the BJT, while the base-emitter fractional voltage generation circuit is in a first configuration; and a second capacitor connected to ground and not to the first capacitor, while the base-emitter fractional voltage generation circuit is in the first configuration;

the first capacitor connected to the second capacitor to generate a fraction of the base emitter voltage such that a bandgap voltage for the base-emitter fractional voltage generation circuit is generated, while the base-emitter fractional voltage generation circuit is in a second configuration;

a value of at least one of the first capacitor or the second capacitor is selected such that temperature compensation is performed when the base-emitter fractional voltage generation circuit is operational, a first base-emitter voltage clamp operatively coupled to the base-emitter fractional voltage generation circuit;

a first charge pump circuit operatively coupled to the first base-emitter voltage clamp;

a second base-emitter voltage clamp operatively coupled to the base-emitter fractional voltage generation circuit; and a second charge pump circuit operatively coupled to the second base-emitter voltage clamp.

11. The apparatus of claim 10, further comprising:

a first switch disposed between the first capacitor and a node associated with receiving the base emitter voltage from the BJT; and a second switch disposed between the second capacitor and ground, the first switch and the second switch being closed while the base-emitter fractional voltage generation circuit is in the first configuration and in the second configuration, respectively.

12. The apparatus of claim 10, further comprising:

a first switch disposed between the first capacitor and the second capacitor; and a second switch disposed between the second capacitor and a load capacitor associated with an output of the base-emitter fractional voltage generation circuit, the first switch and the second switch being open while the base-emitter fractional voltage generation circuit is in the first configuration and in the second configuration, respectively.

13. An apparatus, comprising:

a voltage supply circuit having:

a current source, an oscillator operatively coupled to the current source, and a capacitor operatively coupled to the current source and the oscillator, the current source, the oscillator and the capacitor collectively configured to generate a local supply; and a bandgap reference circuit operatively coupled to the local supply, the bandgap reference having:

a first bipolar junction transistor (BJT) configured to generate a base emitter voltage of the first BJT based on the local supply;

a second bipolar junction transistor (BJT) having a device width greater than a device width of the first BJT, the second BJT configured to generate a base emitter voltage of the second BJT based on the local supply; and a reference generation circuit operatively coupled to the first BJT and the second BJT, the reference generation circuit configured to generate a bandgap reference voltage based on the base emitter voltage of the first BJT and the base emitter voltage of the second BJT, the capacitor is included within a circuit that has a first circuit portion, a second circuit portion and a third circuit portion, the first circuit portion configured to receive a current from the local supply and output a first signal, the first signal having two non-overlapping phases and a voltage range substantially between zero and an input voltage of the circuit, the second circuit portion configured to receive the first signal and output a second signal, the second signal having a voltage range substantially between the input voltage of the circuit and double the input voltage of the circuit, and the third circuit portion configured to receive the second signal and output a third signal, the third signal having a voltage range substantially between zero and double the input voltage of the circuit.

14. The apparatus of claim 13, wherein the oscillator is a current-controlled ring oscillator configured to receive the current from the local supply, the current configured to be temperature dependent but substantially independent of an input voltage of the first BJT and/or the second BJT.

15. The apparatus of claim 13, wherein the capacitor is within a clock doubler configured to double a voltage sweep range of the local supply, the local supply having two non-overlapping clock phases.

16. The apparatus of claim 13, wherein the bandgap reference circuit further has:

a first charge pump circuit operatively coupled to the first BJT and the current source; and a second charge pump circuit operatively coupled to the second BJT and the current source.

17. The apparatus of claim 13, wherein the bandgap reference circuit further has:

a first charge pump circuit operatively coupled to the first BJT and the current source, the first charge pump circuit configured to receive an input voltage from the current source and to output the base emitter voltage of the first BJT, the input voltage for the first charge pump circuit being less than the base emitter voltage of the first BJT; and a second charge pump circuit operatively coupled to the second BJT and the current source, the second charge pump configured to receive an input voltage from the current source and to output the base emitter voltage of the second BJT, the input voltage for the second charge pump circuit being less than the base emitter voltage of the second BJT.

18. The apparatus of claim 13, wherein the bandgap reference circuit further has:

a first charge pump circuit operatively coupled to the first BJT and the current source, the first charge pump having a first configuration when receiving a first phase of the local supply and a second configuration when receiving a second phase of the local supply, the first charge pump configured to output the base emitter voltage of the first BJT based on a first charge stored at a first capacitor during the first configuration and the second configuration of the first charge pump; and a second charge pump circuit operatively coupled to the second BJT and the current source, the second charge pump having a first configuration when receiving the first phase of the local supply and a second configuration when receiving the second phase of the local supply, the second charge pump configured to output the base emitter voltage of the second BJT based on a second charge stored at a second capacitor during the first configuration and the second configuration of the second charge pump.

19. An apparatus, comprising:

a bandgap reference circuit having:

a first base-emitter voltage clamp operatively coupled to a reference generation circuit, the first base-emitter voltage clamp including a first bipolar junction transistor (BJT) configured to generate a base emitter voltage of the first BJT based on a first input voltage of the first BJT that is lower than the base emitter voltage of the first BJT;

a second base-emitter voltage clamp operatively coupled to the reference generation circuit, the second base-emitter voltage clamp including a second bipolar junction transistor (BJT) having a device width greater than a device width of the first BJT, the second BJT configured to generate a base emitter voltage of the second BJT based on a second input voltage of the second BJT that is lower than the base emitter voltage of the second BJT;

a first charge pump circuit operatively coupled to the first base-emitter voltage clamp;

a second charge pump circuit operatively coupled to the second base-emitter voltage clamp; and the reference generation circuit operatively coupled to the first BJT and the second BJT, the reference generation circuit configured to generate a bandgap reference voltage based on the base emitter voltage of the first BJT and the base emitter voltage of the second BJT.

20. The apparatus of claim 1, wherein:

the first input voltage is no greater than half of the base emitter voltage of the first BJT, and/or the second input voltage is no greater than half of the base emitter voltage of the second BJT.

* * * * *